US011232936B2

(12) United States Patent
Gajadhar et al.

(10) Patent No.: US 11,232,936 B2
(45) Date of Patent: Jan. 25, 2022

(54) ABSOLUTE QUANTITATION OF A TARGET ANALYTE USING A MASS SPECTROMETER

(71) Applicant: Thermo Finnigan LLC, San Jose, CA (US)

(72) Inventors: Aaron Gajadhar, San Jose, CA (US); Sebastien F. Gallien, Courtaboef (FR)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 17/002,487

(22) Filed: Aug. 25, 2020

(65) Prior Publication Data

US 2021/0375604 A1 Dec. 2, 2021

Related U.S. Application Data

(60) Provisional application No. 63/031,188, filed on May 28, 2020.

(51) Int. Cl.
*H01J 49/00* (2006.01)

(52) U.S. Cl.
CPC ..... *H01J 49/0036* (2013.01); *H01J 49/0009* (2013.01)

(58) Field of Classification Search
CPC ..... G01N 30/72; G01N 33/28; G01N 1/405; G01N 2030/042; G01N 2030/8854;
(Continued)

(56) References Cited

U.S. PATENT DOCUMENTS 5,668,373 A * 9/1997 Robbat, Jr. ..... G01N 1/405 250/339.12
5,808,180 A * 9/1998 Roussis ..... G01N 33/2823 73/23.35

(Continued)

FOREIGN PATENT DOCUMENTS

EP 2208992 A1 7/2010
EP 3 004 861 A1 4/2016

(Continued)

OTHER PUBLICATIONS

Gallien et al., Large Scale Targeted Proteomics Using Internal Standard Triggered-Parallel Reaction Monitoring (IS-PRM), Tecnological Innovation and Resources by the American Society for Biochemistryu and Molecular Biology, Inc., 2015, pp. 1630-1644.

(Continued)

*Primary Examiner* — David A Vanore

(57) ABSTRACT

A targeted quantitation system for mass spectrometry may acquire, while operating in a watch mode, a watch mode mass spectrum including mass peaks for ions produced from a plurality of internal standard variants added to a sample comprising a target analyte. Each internal standard variant included in the plurality of internal standard variants includes a unique isotopologue of the target analyte and is added to the sample in a unique amount. The targeted quantitation system may generate a calibration curve based on the watch mode mass spectrum. The targeted quantitation system may acquire, while operating in a quantitation mode, a quantitation mode mass spectrum including mass peaks for ions produced from the target analyte included in the sample. The targeted quantitation system may determine a concentration of the target analyte included in the sample based on the calibration curve and the second mass spectrum.

24 Claims, 13 Drawing Sheets

(58) Field of Classification Search
CPC ..... G01N 21/274; G01N 2440/20; G01N 2440/38; G01N 2560/00; G01N 30/68; G01N 30/7206; G01N 30/78; G01N 30/8624; G01N 30/8637; G01N 30/8644; G01N 30/8665; G01N 30/8668; G01N 30/8686; G01N 33/2823; G01N 33/6842; G01N 33/6848; H01J 49/0009; H01J 49/0027; H01J 49/0031; H01J 49/022; H01J 49/049; H01J 49/105; H01J 49/28; H01J 49/4205; H01J 49/4215; H01J 49/4275; H01J 49/429; H01J 49/0036
USPC ..... 250/282, 339.07, 339.12
See application file for complete search history.

(56) References Cited

U.S. PATENT DOCUMENTS 6,452,179 B1 * 9/2002 Coates ..... G01J 3/443 250/339.09
8,413,484 B2 * 4/2013 Lubkowitz ..... G01N 30/78 73/23.35
9,252,003 B2 2/2016 Hermanson
9,366,678 B2 * 6/2016 Coon ..... G01N 33/6848
10,453,662 B2 * 10/2019 McAlister ..... H01J 49/0072
2003/0044994 A1 * 3/2003 Bandura ..... G01N 30/72 436/57
2004/0031918 A1 * 2/2004 Schoen ..... H05K 1/0212 250/282
2006/0255258 A1 * 11/2006 Wang ..... G01N 30/8665 250/282
2007/0181798 A1 * 8/2007 Lubkowitz ..... G01N 30/8675 250/288
2012/0205535 A1 * 8/2012 Lemoine ..... H01J 49/427 250/282
2014/0156202 A1 * 6/2014 Floridia ..... G16H 10/40 702/23
2014/0364337 A1 * 12/2014 Hermanson ..... G01N 33/6848 506/12
2018/0350578 A1 * 12/2018 Yip ..... H01J 49/005
2019/0049460 A1 2/2019 Kobold et al.
2019/0094205 A1 * 3/2019 Sakairi ..... G16H 10/40
2019/0187152 A1 * 6/2019 Reiter ..... G01N 33/6842
2021/0082679 A1 * 3/2021 Green ..... H01J 49/429

FOREIGN PATENT DOCUMENTS

WO 2020079614 A 4/2020
WO 2020117849 A1 6/2020

OTHER PUBLICATIONS

Stopher et al. "High Density, targeted monitoring of tyrosine phosphorylation reveals activated signaling networks in human tumors," BioRxiv, Jun. 2, 2020, 63 pages.
Lesur et al., "Hyphenation of fast liquid chromatography with high-resolution mass spectrometry for quantitative protemics analyses," Trends in Analytical Chemistry, 2016, 17 pages.
EP Extended Search and Examination Report dated Oct. 29, 2021, to EP Patent Application No. 21176607.6.

* cited by examiner

ABSOLUTE QUANTITATION OF A TARGET ANALYTE USING A MASS SPECTROMETER

PRIORITY INFORMATION

The present application claims priority to U.S. Provisional Patent Application No. 63/031,188, filed on May 28, 2020, and entitled "SYSTEMS AND METHODS FOR ABSOLUTE QUANTITATION OF A TARGET ANALYTE," the contents of which are hereby incorporated by reference in their entirety.

BACKGROUND INFORMATION

A mass spectrometer is a sensitive instrument that may be used to detect, identify, and/or quantitate molecules based on their mass-to-charge (m/z) ratio. A mass spectrometer (MS) generally includes an ion source for generating ions from the sample, a mass analyzer for separating the ions based on their mass-to-charge ratio, and an ion detector for detecting the separated ions. The mass spectrometer may be connected to a computer-based software platform that uses data from the ion detector to construct a mass spectrum that shows a relative abundance of each of the detected ions as a function of their mass-to-charge ratio. The measured mass-to-charge ratio of ions may be used to detect and quantitate molecules in simple and complex mixtures.

However, the selective detection and quantitation of a specific target molecule of interest in a complex mixture is often very difficult, even with targeted acquisition. For example, in proteomics research, a peptide target of interest may be included in a complex biological matrix composed of a mixture of tens of thousands of peptides with abundances spanning many orders of magnitude. Tandem mass spectrometry may be used for the quantitation of a target molecule in a complex mixture. For example, in a refined targeted acquisition technique known as internal standard triggered-parallel reaction monitoring (IS-PRM), a sample containing a peptide target may be spiked with a known amount of the corresponding internal standard (IS) (e.g., a synthetic peptide with the same amino acid sequence but containing heavy stable isotope(s)) and scanned by the instrument in a dual-mode combining single stage and tandem mass spectrometry. Detection of the internal standard triggers the mass spectrometer to monitor for the specific peptide target of interest.

However, this refined targeted acquisition technique may suffer from several limitations. For example, the technique suffers from false positive triggering due to the presence of near isobaric co-isolated interferences in complex samples, which mimic accurate masses of the internal standards during the scanning stage. Additionally, the absolute quantitation of a target analyte requires extrapolation or interpolation from a calibration curve established from an independent analysis of internal standards, which are collected from multiple additional mass spectrometry experiments.

SUMMARY

The following description presents a simplified summary of one or more aspects of the methods and systems described herein in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects of the methods and systems described herein in a simplified form as a prelude to the more detailed description that is presented below.

In some exemplary embodiments, a system comprises a memory storing instructions and a processor communicatively coupled to the memory and configured to execute the instructions to acquire, while operating in a watch mode, a watch mode mass spectrum including mass peaks for ions produced from a plurality of internal standard variants added to a sample comprising a target analyte, each internal standard variant included in the plurality of internal standard variants comprising a unique isotopologue of the target analyte and being added to the sample in a unique amount; generate a calibration curve based on the watch mode mass spectrum; acquire, while operating in a quantitation mode, a quantitation mode mass spectrum including mass peaks for ions produced from the target analyte included in the sample; and determine a concentration of the target analyte included in the sample based on the calibration curve and the quantitation mode mass spectrum.

In some exemplary embodiments, the processor is further configured to execute the instructions to acquire, while operating in the watch mode, mass spectra during an analytical run of the sample, the mass spectra including the watch mode mass spectrum; analyze the mass spectra based on a criteria set associated with the plurality of internal standard variants; and determine, based on the analysis, that the watch mode mass spectrum includes the mass peaks for the ions produced from the plurality of internal standard variants added to the sample.

In some exemplary embodiments, the acquiring of the quantitation mode mass spectrum is performed in response to the determination that the watch mode mass spectrum includes the mass peaks for the ions produced from the plurality of internal standard variants added to the sample.

In some exemplary embodiments, the generating of the calibration curve is performed in response to the determination that the watch mode mass spectrum includes the mass peaks for the ions produced from the plurality of internal standard variants added to the sample.

In some exemplary embodiments, the determining that the watch mode mass spectrum includes the mass peaks for the ions produced from the plurality of internal standard variants added to the sample comprises determining that a set of mass peaks included in the watch mode mass spectrum satisfy the criteria set, the set of mass peaks comprising the mass peaks for the ions produced from the plurality of internal standard variants.

In some exemplary embodiments, the criteria set comprises one or more of: a mass-to-charge ratio, a signal intensity, or a peptide sequence for each of the plurality of internal standard variants added to the sample.

In some exemplary embodiments, the watch mode comprises a basic watch mode and an enhanced watch mode, the watch mode mass spectrum comprises an enhanced watch mode mass spectrum, and the processor is further configured to execute the instructions to acquire, while operating in the basic watch mode, a basic watch mode mass spectrum including mass peaks for precursor ions produced from the plurality of internal standard variants; direct, in response to the acquiring of the basic watch mode mass spectrum, a mass spectrometry system to selectively fragment the precursor ions into a plurality of fragment ions, the plurality of fragment ions comprising the ions produced from the plurality of internal standard variants; and acquire, while operating in the enhanced watch mode, the enhanced watch mode mass spectrum from a scan of the plurality of fragment ions.

In some exemplary embodiments, the processor is further configured to execute the instructions to direct a mass spectrometry system to scan the ions produced from the plurality of internal standard variants added to the sample in accordance with a first operating mode such that the watch mode mass spectrum is generated while the mass spectrometry system operates in the first operating mode; and direct the mass spectrometry system to scan the ions produced from the target analyte included in the sample in accordance with a second operating mode such that the quantitation mode mass spectrum is generated while the mass spectrometry system operates in the second operating mode.

In some exemplary embodiments, a method comprises acquiring, by a targeted quantitation system while operating in a watch mode, a watch mode mass spectrum including mass peaks for ions produced from a plurality of internal standard variants added to a sample comprising a target analyte, each internal standard variant included in the plurality of internal standard variants comprising a unique isotopologue of the target analyte and being added to the sample in a unique amount; generating, by the targeted quantitation system, a calibration curve based on the watch mode mass spectrum; acquiring, by the targeted quantitation system while operating in a quantitation mode, a quantitation mode mass spectrum including mass peaks for ions produced from the target analyte included in the sample; and determining, by the targeted quantitation system, a concentration of the target analyte included in the sample based on the calibration curve and the quantitation mode mass spectrum.

In some exemplary embodiments, a non-transitory computer-readable medium stores instructions that, when executed, direct at least one processor of a computing device for a mass spectrometry system to acquire, while operating in a watch mode, a watch mode mass spectrum including mass peaks for ions produced from a plurality of internal standard variants added to a sample comprising a target analyte, each internal standard variant included in the plurality of internal standard variants comprising a unique isotopologue of the target analyte and being added to the sample in a unique amount; generate a calibration curve based on the watch mode mass spectrum; acquire, while operating in a quantitation mode, a quantitation mode mass spectrum including mass peaks for ions produced from the target analyte included in the sample; and determine a concentration of the target analyte included in the sample based on the calibration curve and the quantitation mode mass spectrum.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements. Furthermore, the figures are not necessarily drawn to scale as one or more elements shown in the figures may be enlarged or resized to facilitate recognition and discussion.

DETAILED DESCRIPTION

Systems and methods for absolute quantitation of a target analyte are described herein. In some embodiments, a plurality of distinct, isotopologous variants of an internal standard variant corresponding to a target analyte are added to a sample comprising the target analyte. Each internal standard variant may comprise a unique isotopologue of the target analyte. Furthermore, each internal standard variant is added to the sample in a unique amount (e.g., in a different concentration in the sample). A targeted quantitation system may acquire, while operating in a watch mode, a watch mode mass spectrum including mass peaks for ions produced from the plurality of internal standard variants. The targeted quantitation system may generate a calibration curve based on the watch mode mass spectrum. The targeted quantitation system may also acquire, while operating in a quantitation mode, a quantitation mode mass spectrum including mass peaks for ions produced from the target analyte included in the sample. The targeted quantitation system may determine a concentration of the target analyte included in the sample based on the calibration curve and the quantitation mode mass spectrum.

The systems and methods described herein may provide various benefits, which may include one or more advantages over conventional targeted quantitation systems and methods. For example, a single sample can be used to generate a calibration curve and quantitate a target analyte included in the sample. This eliminates the need to conduct a separate experiment to generate a calibration curve. Moreover, detection and quantitation of the target analyte may be conditioned on detection of multiple different internal standard variants, thereby reducing the occurrence of false positive triggers as compared to existing internal standard variant trigger techniques, which rely on a single internal standard variant trigger per target analyte. Moreover, due to the high specificity provided by detection of multiple internal standard variants, the use of signal intensity thresholds to trigger targeted acquisition may be eliminated, thereby improving efficiency of the targeted quantitation analyses.

Figure 1A:
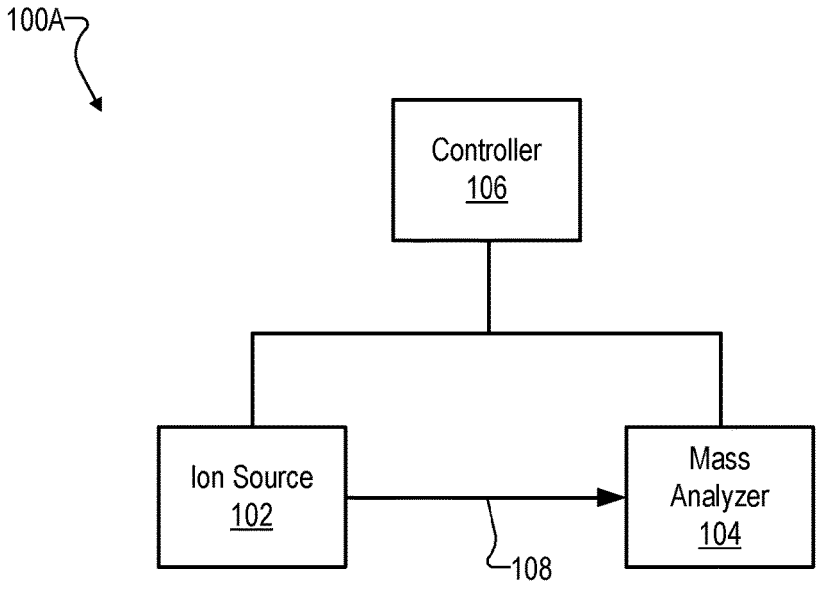
FIG. 1A illustrates functional components of an exemplary mass spectrometer.

The targeted quantitation systems and methods described herein may be implemented in conjunction with a mass spectrometer. FIG. 1A illustrates functional components of an exemplary mass spectrometer 100A. The exemplary mass spectrometer 100A is illustrative and not limiting. As shown, mass spectrometer 100A includes an ion source 102, a mass analyzer 104, and a controller 106. Mass spectrometer 100A may further include any additional or alternative components (not shown) as may suit a particular implementation (e.g., ion optics, filters, an autosampler, etc.).

Ion source 102 is configured to produce a plurality of ions 108 from a sample to be analyzed and to deliver the ions to mass analyzer 104. Ion source 102 may use any suitable ionization technique, including without limitation electron ionization, chemical ionization, matrix assisted laser desorption/ionization, electrospray ionization, atmospheric pressure chemical ionization, atmospheric pressure photoionization, inductively coupled plasma, and the like. Ion source 102 may include various components for producing ions from a sample and delivering the resulting ions 108 to mass analyzer 104.

Mass analyzer 104 is configured to separate the ions 108 according to the mass-to-charge ratio (m/z) of each of the ions. Mass analyzer 104 may be implemented, for example, by a quadrupole mass filter, an ion trap (e.g., a three-dimensional quadrupole ion trap, a cylindrical ion trap, a linear quadrupole ion trap, a toroidal ion trap, etc.), a time-of-flight (TOF) mass analyzer, an electrostatic trap mass analyzer (e.g. an orbital electrostatic trap such as an Orbitrap mass analyzer, Kingdon trap, etc.), a Fourier transform ion cyclotron resonance (FT-ICR) mass analyzer, a sector mass analyzer, and the like.

In some examples, mass analyzer 104 may include one or more multipole assemblies having a plurality of rod electrodes (e.g., a quadrupole, a hexapole, an octapole, etc.) for use in guiding, trapping, and/or filtering ions. In a quadrupole, opposite phases of RF voltage may be applied to pairs of rod electrodes, thereby generating a quadrupolar electric field that guides or traps ions within a center region of the quadrupole. In quadrupole mass filters, a mass resolving direct current (DC) voltage may also be applied to the pairs of rod electrodes, thereby superimposing a DC electric field on the quadrupolar electric field and causing a trajectory of some ions to become unstable and causing the unstable ions to discharge against one of the rod electrodes. In such quadrupole mass filters, only ions having a certain mass-to-charge ratio will maintain a stable trajectory and traverse the length of the quadrupole, wherein they are emitted from the mass filter and subsequently detected by an ion detector included in mass analyzer 104. In some examples mass analyzer 104 may be coupled to an oscillatory voltage power supply (not shown) configured to supply the RF voltage to the multipole assembly, and may be coupled to a DC voltage power supply configured to supply a mass resolving DC voltage to the multipole assembly.

Mass analyzer 104 includes an ion detector configured to detect ions separated by mass analyzer 104 at each of a variety of different mass-to-charge ratios and responsively generate an electrical signal representative of ion intensity (quantity of ions) or relative abundance of the ions. The electrical signal is transmitted to controller 106 for processing, such as to construct a mass spectrum of the sample. For example, mass analyzer 104 may emit an emission beam of separated ions to the ion detector, which is configured to detect the ions in the emission beam and generate or provide data that can be used by controller 106 to construct a mass spectrum of the sample. The ion detector may be implemented by any suitable detection device, including without limitation an electron multiplier, a Faraday cup, and the like.

Controller 106 may be communicatively coupled with, and configured to control operations of, ion source 102 and/or mass analyzer 104. For example, controller 106 may be configured to control operation of various hardware components included in ion source 102 and/or mass analyzer 104. To illustrate, controller 106 may be configured to control a fill time of ion source 102 and/or mass analyzer 104. Controller 106 may further be configured to control the oscillatory voltage power supply and/or the DC power supply to supply the RF voltage and/or the DC voltage to mass analyzer 104 (e.g., to a multipole assembly included in mass analyzer 104), and adjust values of the RF voltage and DC voltage to select an effective range of the mass-to-charge ratio of ions to detect. Controller 106 may also adjust the sensitivity of the ion detector, such as by adjusting the detector gain.

Controller 106 may also include and/or provide a user interface configured to enable interaction between a user of mass spectrometer 100A and controller 106. The user may interact with controller 106 via the user interface by tactile, visual, auditory, and/or other sensory type communication. For example, the user interface may include a display device (e.g., liquid crystal display (LCD) display screen, a touch screen, etc.) for displaying information (e.g., mass spectra, notifications, etc.) to the user. The user interface may also include an input device (e.g., a keyboard, a mouse, a touchscreen device, etc.) that allows the user to provide input to controller 106. In other examples the display device and/or input device may be separate from, but communicatively coupled to, controller 106. For instance, the display device and the input device may be included in a computer (e.g., a desktop computer, a laptop computer, etc.) communicatively connected to controller 106 by way of a wired connection (e.g., by one or more cables) and/or a wireless connection.

Controller 106 may include hardware (e.g., a processor, circuitry, etc.) and/or software configured to control operations of the various components of mass spectrometer 100A. While FIG. 1 shows that controller 106 is included in mass spectrometer 100A, controller 106 may alternatively be implemented in whole or in part separately from mass spectrometer 100A, such as by a computing device communicatively coupled to mass spectrometer 100A by way of a wired connection (e.g., a cable) and/or a network (e.g., a local area network, a wireless network (e.g., Wi-Fi), a wide area network, the Internet, a cellular data network, etc.).

Operation of mass spectrometer 100A will now be described. During a mass analysis of a sample, controller 106 directs ion source 102 to produce ions 108 from a sample and deliver ions 108 to mass analyzer 104. Controller 106 directs mass analyzer 104 to scan across a range of mass-to-charge ratios to selectively filter the produced ions according to their mass-to-charge ratio. At any given point in time during an analytical scan, the ions detected in mass analyzer 104 have a selected mass-to-charge ratio. Mass spectrometer 100A may operate in a mode where the selected mass-to-charge ratio progressively increases (or progressively decreases) during the scan. Mass spectrometer 100A may alternatively operate in a mode in which the selected mass-to-charge ratio does not progressively increase (or decrease), but is instead constant or discontinuous, such as in a selected ion monitoring (SIM) mode or a selected reaction monitoring (SRM) mode.

The detector detects an ion intensity (quantity) for the ions of each mass-to-charge ratio scanned in mass analyzer 104. The detector generates electrical signals (ion signals) corresponding to the detected ion intensity and transmits the ion signals to controller 106, which may save the data, process the data, and/or generate mass spectra based on the data.

Figure 1B:
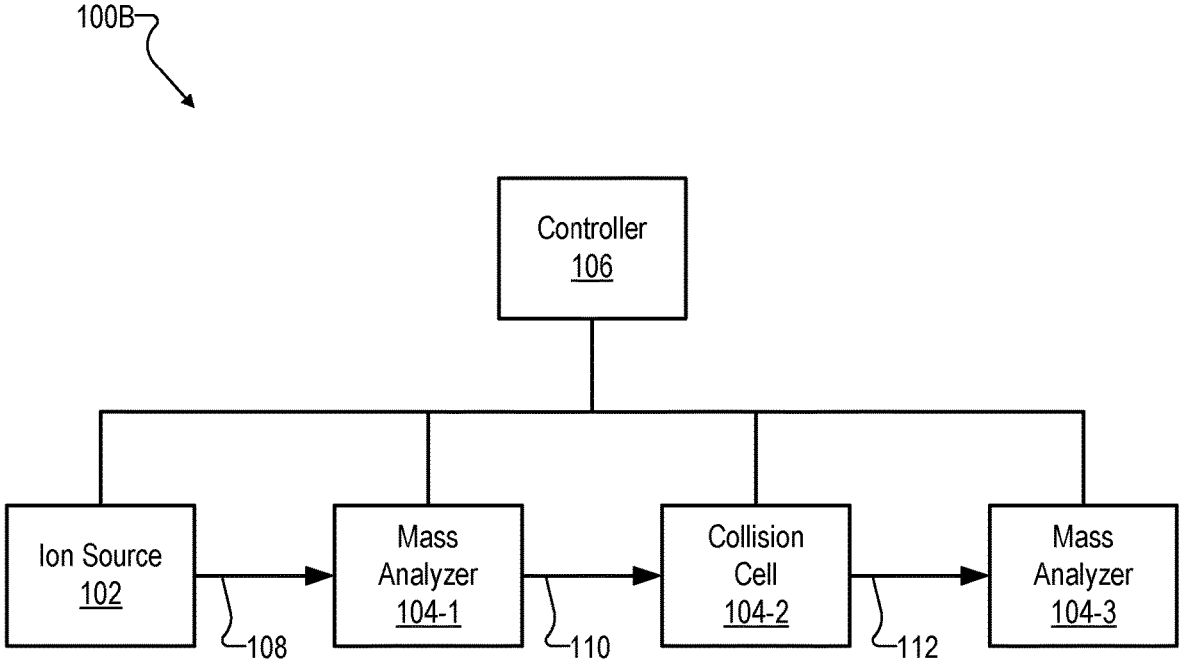
FIG. 1B illustrates functional components of an exemplary tandem mass spectrometer.

In some embodiments, a mass spectrometer may comprise a tandem mass spectrometer. FIG. 1B illustrates functional components of an exemplary tandem mass spectrometer 100B. The exemplary tandem mass spectrometer 100B is illustrative and not limiting. Mass spectrometer 100B is the same as mass spectrometer 100A except that mass analyzer 104 is replaced with a first mass analyzer 104-1, a collision cell 104-2, and a second mass analyzer 104-3. First mass analyzer 104-1 is configured to receive ions 108 produced by ion source 102 and produce precursor ions 110. Collision cell 104-2 is configured to receive precursor ions 110 and produce product ions 112 (e.g., fragment ions) from precursor ions 110. Second mass analyzer 104-3 is configured to scan and/or filter product ions 112 from collision cell 104-2. Mass analyzers 104-1 and 104-3 may be implemented by any suitable mass analyzer, and need not be implemented by the same type of mass analyzer. Collision cell 104-2 may be implemented by any suitable collision cell. The term "collision cell," as used herein, may encompass any structure arranged to produce product ions via controlled dissociation processes and is not limited to devices employed for collisionally-activated dissociation. For example, collision cell 104-2 may be configured to fragment precursor 110 ions using collision induced dissociation, electron transfer dissociation, electron capture dissociation, photo induced dissociation, surface induced dissociation, ion/molecule reactions, and the like.

While mass spectrometer 1008 is shown as a tandem-in-space mass spectrometer, mass spectrometer 1008 may alternatively be implemented as a tandem-in-time mass spectrometer.

Figure 2:
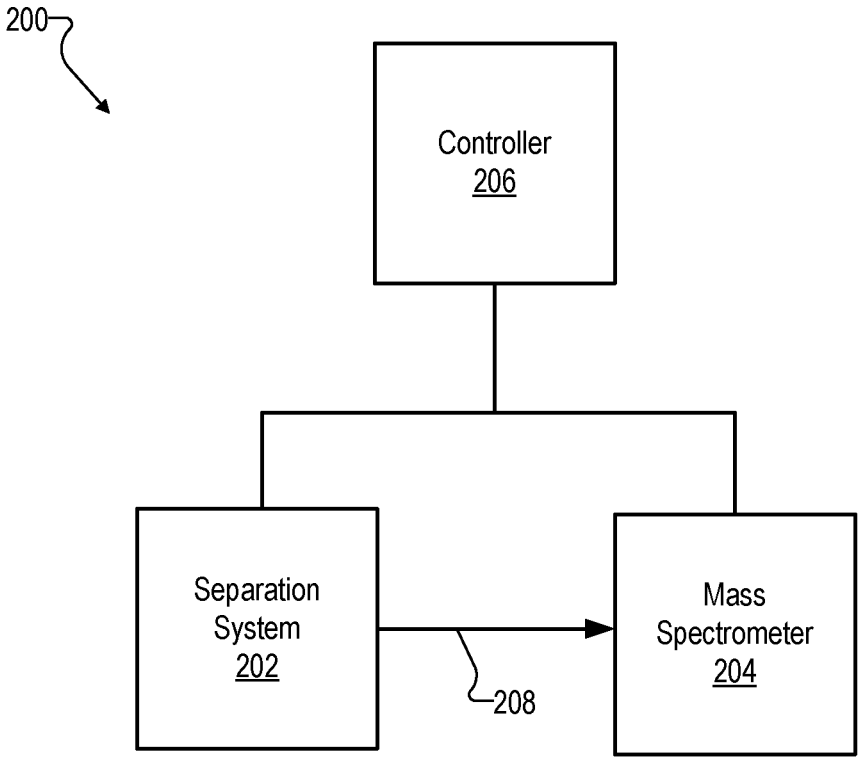
FIG. 2 illustrates an exemplary combined separation and mass spectrometer system.

In some embodiments, a mass spectrometer 100 (e.g., mass spectrometer 100A or 1008, each of which are referred to herein as mass spectrometer 100) may be coupled with a separation system configured to separate components of a sample to be analyzed by mass spectrometer 100. FIG. 2 illustrates an exemplary combined separation and mass spectrometer system 200 ("combined system 200"). As shown, combined system 200 includes a separation system 202, a mass spectrometer 204, and a controller 206. Combined system 200 may include additional or alternative components as may suit a particular implementation.

In an analytical run performed by combined system 200, separation system 202 is configured to receive a sample to be analyzed and separate certain components within the sample. In some examples, separation system 202 may also detect a relative abundance of the separated components, such as by generating a chromatogram representative of the components within the sample. Separation system 202 may be implemented by any device configured to separate components included in the sample, such as a liquid chromatograph (LC) (e.g., a high-performance liquid chromatograph (HPLC)), a gas chromatograph (GC), an ion chromatograph, a capillary electrophoresis system, and the like. Components 208 separated by separation system 202 are delivered to mass spectrometer 204 for a mass analysis by mass spectrometer 204.

For example, in LC a sample may be injected into a mobile phase (e.g., a solvent), which carries the sample through a column containing a stationary phase (e.g., an adsorbent packing material). As the mobile phase passes through the column, components 208 within the sample elute from the column at different times based on, for example, their size, their affinity to the stationary phase, their polarity, and/or their hydrophobicity. The retention time of components 208 may also be affected by LC conditions, such as mobile phase flow rate and solvent composition. A detector (e.g., a spectrophotometer) may measure the relative intensity of a signal modulated by each separated component (eluite) in the effluent from the column and represent the signal as a chromatograph. In some examples, the relative intensity may be correlated to or representative of relative abundance of the separated components. Data generated by the LC may be output to controller 206.

Mass spectrometer 204 may be implemented by any suitable type of mass spectrometer (e.g., mass spectrometer 100). Thus, combined system 200 may comprise, for example, an LC-MS system, LC-MS/MS system, GC-MS system, GC-MS/MS system, or the like.

Controller 206 is communicatively coupled with, and configured to control operations of, combined system 200 (e.g., separation system 202 and/or mass spectrometer 204). Controller 206 may include hardware (e.g., a processor, circuitry, etc.) and/or software configured to control operations of the various components of combined system 200. While FIG. 2 shows that controller 206 is included in combined system 200, controller 206 may alternatively be implemented in whole or in part separately from combined system 200, such as by a computing device communicatively coupled to combined system 200 by way of a wired connection (e.g., a cable) and/or a network (e.g., a local area network, a wireless network (e.g., Wi-Fi), a wide area network, the Internet, a cellular data network, etc.). In examples where mass spectrometer 204 is implemented by mass spectrometer 100, controller 206 may be implemented in whole or in part by controller 106.

Figure 3:
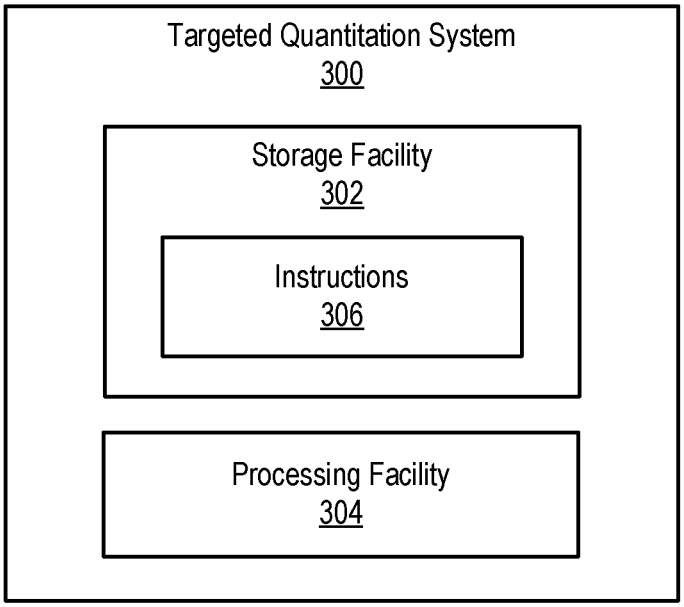
FIG. 3 illustrates an exemplary targeted quantitation system configured to quantitate a target analyte included in a sample.

FIG. 3 illustrates an exemplary targeted quantitation system 300 ("system 300") configured to quantitate a target analyte included in a sample analyzed by mass spectrometer 100 or combined system 200. As shown in FIG. 3, system 300 may include, without limitation, a storage facility 302 and a processing facility 304 selectively and communicatively coupled to one another. System 300 (e.g., facilities 302 and 304) may include or be implemented by hardware and/or software components (e.g., processors, memories, communication interfaces, instructions stored in memory for execution by the processors, etc.). In some examples, facilities 302 and 304 may be distributed between multiple devices and/or multiple locations as may serve a particular implementation.

Storage facility 302 may maintain (e.g., store) executable data used by processing facility 304 to perform any of the operations described herein. For example, storage facility 302 may store instructions 306 that may be executed by processing facility 304 to perform any of the operations described herein. Instructions 306 may be implemented by any suitable application, software, code, and/or other executable data instance. Storage facility 302 may also maintain any data received, generated, managed, used, and/or transmitted by processing facility 304. For example, storage facility 302 may maintain criteria data, mass spectra data, and/or calibration data.

Processing facility 304 may be configured to perform (e.g., execute instructions 306 stored in storage facility 302 to perform) various processing operations associated with targeted quantitation of a target analyte included in a sample. These and other operations that may be performed by processing facility 304 are described herein. In the description below, any references to operations performed by system 300 may be understood to be performed by processing facility 304 of system 300.

Figure 4:
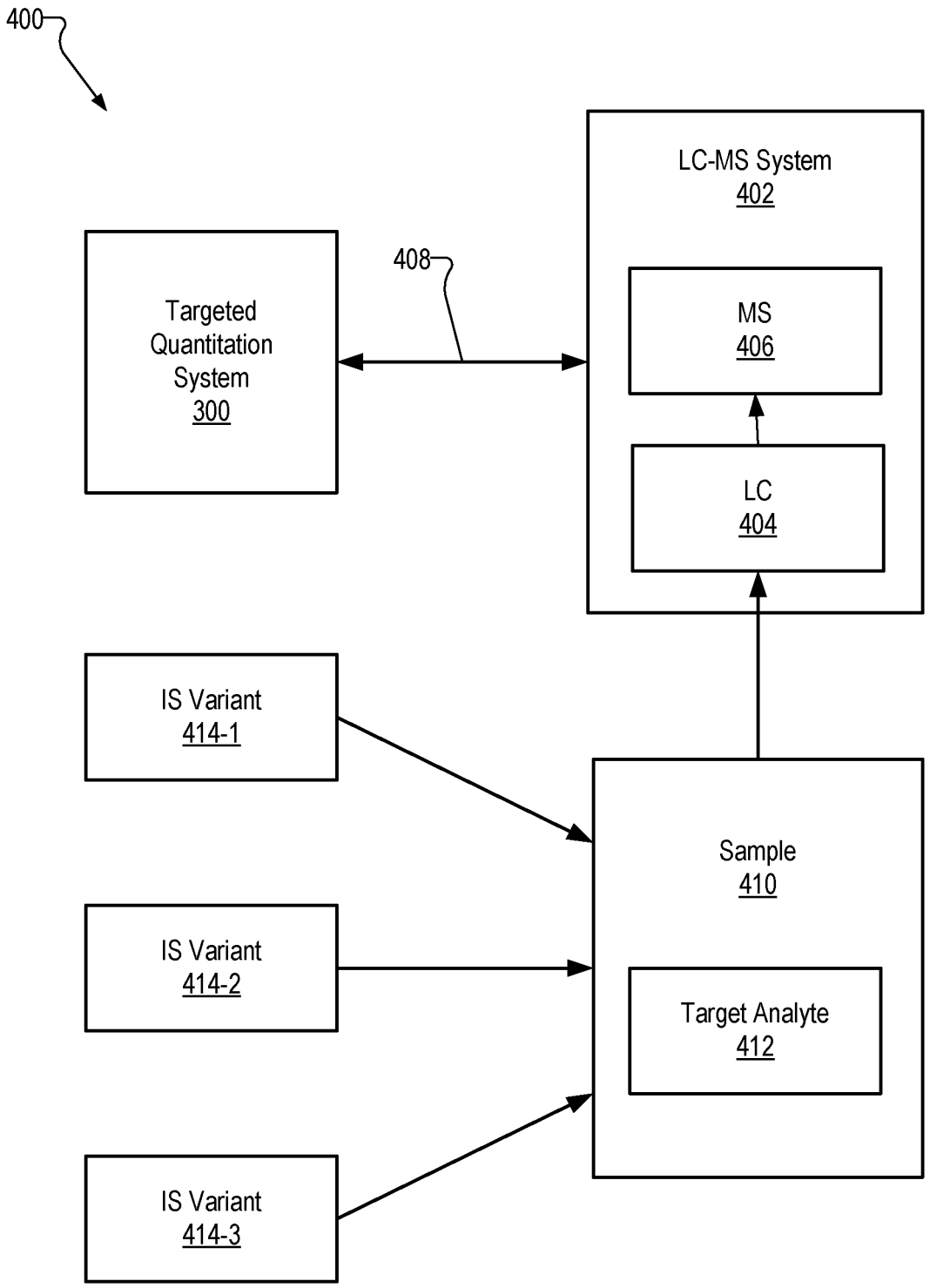
FIG. 4 illustrates an exemplary implementation of the targeted quantitation system of FIG. 3.

FIG. 4 illustrates an exemplary implementation 400 of system 300. As shown, system 300 is communicatively coupled with a liquid chromatography-mass spectrometry system 402 ("LC-MS system 402"). LC-MS system 402 comprises a combined system (e.g., combined system 200). As shown, LC-MS system 402 includes a liquid chromatography system 404 ("LC 404") and a mass spectrometer 406 ("MS 406"). LC 404 may be implemented by any suitable liquid chromatography system, and MS 406 may be implemented by any suitable mass spectrometer (e.g., mass spectrometer 100A or tandem mass spectrometer 100B). In alternative implementations, LC-MS system 402 may be replaced with a GC-MS system or a standalone mass spectrometer (e.g., only MS 406).

System 300 is communicatively coupled to LC-MS system 402 by way of a bidirectional communication link 408. Communication link 408 may be implemented by any suitable wired and/or wireless communication connection(s) and/or network(s) (e.g., a local area network, a wireless network (e.g., Wi-Fi), a wide area network, the Internet, a cellular data network, etc.) as may serve a particular implementation. System 300 may use communication link 408 to control certain operations of LC-MS system 402 and to receive signals and/or data from LC-MS system 402. As shown, system 300 is separate from LC-MS system 402. In alternative implementations, system 300 is implemented entirely or in part as part of LC-MS system 402. For example, system 300 may be implemented entirely or in part by controller 106 of mass spectrometer 100 or by controller 206 of combined system 200.

LC-MS system 402 may perform an analytical run on a sample 410 containing a target analyte 412. Sample 410 may be any suitable sample, such as a sample collected from a body or from the environment, a synthesized composition, and the like. Sample 410 may include, for example, nucleotides, peptides, steroids, hormones, dyes, alcohols, phenols, alkaloids, organic acids, fatty acids, amino acids, amines, polyamines, nucleosides, prostaglandins, carotenoids, eicosanoids, esters, perfumes, terpenes, waxes, volatiles, flavonoids, lipids, etc. Target analyte 412 may be any individual component included in sample 410. For example, in targeted proteomics analyses sample 410 may be collected from a cell, tissue, or other biological source and target analyte 412 may be a particular peptide included in sample 410 (e.g., a peptide generated by proteolytic digestion of a protein included in sample 410).

To facilitate targeted quantitation operations performed by system 300, sample 410 is spiked with known but unique (different) amounts of a plurality of internal standard variants ("IS variants") 414-1 through 414-3. For example, the amount of IS variant 414-1 is different than the amount of IS variant 414-2 and the amount of IS variant 414-3, and the amount of IS variant 414-2 is different than the amount of IS variant 414-3. Each IS variant corresponds to target analyte 412. While FIG. 4 shows three IS variants 414 added to sample 410, any other suitable number of IS variants 414 greater than one may be added to sample 410.

IS variants 414 may be implemented by any suitable chemical compounds. In some examples, IS variants 414 are isotopologues of target analyte 412 (e.g., distinct isotopologous versions of a unique amino acid sequence, signature peptide, proteotypic peptide, etc.). For instance, when target analyte 412 is a proteotypic peptide, IS variants 414 may be stable isotope-labeled (SIL) peptides (e.g., peptides labeled with stable, non-radioactive isotopes, such as $^{13}C$ (carbon-13), $^{15}N$ (nitrogen-15), and $^{2}H$ (deuterium)). IS variants 414 co-elute from LC 404 with the corresponding target analyte 412 due to their similar structure. Accordingly, as will be described below in more detail, system 300 may determine, based on detection of a plurality of IS variants 414 in mass spectra acquired from LC-MS system 402, that target analyte 412 is also present and available for detection and targeted quantitation.

Each IS variant 414 has a mass that is different from the masses of the other IS variants 414. For example, each IS variant 414 may comprise a different isotopologue of target analyte 412. Thus, a mass of IS variant 414-1 is different from the masses of IS variants 414-2 and 414-3; a mass of IS variant 414-2 is different from the masses of IS variants 414-1 and 414-3; and a mass of IS variant 414-3 is different from the masses of IS variants 414-1 and 414-2. A mass of target analyte 412 is also different from the masses of IS variants 414. As a result, target analyte 412 and each IS variant 414 will have independently detectable mass peaks in a mass spectrum acquired during an analytical run of sample 410.

In addition to different masses, each IS variant 414 is added to sample 410 in a known but unique amount. That is, the concentration of each IS variant 414 within sample 410 is different from the concentration of the other IS variants 414 within sample 410. For example, IS variant 414-1 may be added to sample 410 in a first concentration (e.g., 100 femtomole/liter (fmol/L)), IS variant 414-2 may be added to sample 410 in a second concentration (e.g., 10 fmol/L), and IS variant 414-3 may be added to sample 410 in a third concentration (e.g., 0.1 fmol/L). Thus, in the mass spectrum acquired during the analytical run, the mass peaks corresponding to each IS variant 414 will have different signal intensities.

IS variants 414 may be added to sample 410 in any suitable way. For example, IS variants 414 may be added to sample 410 manually prior to injection of sample 410 into LC-MS system 402. Alternatively, IS variants 414 may be automatically added to sample 410 by an autosampler included in LC-MS system 402.

In some examples, IS variants 414 are included in a kit designed for use in a targeted quantitation analysis. The kit may include a plurality of containers having IS variants 414 in predefined but distinct concentrations. In some examples, the containers may also include a label that provides information about the particular IS variant 414, such as the mass, quantity, and/or ID of the IS variant in the container. The IS variant containers and a sample container (for sample 410) may be placed in an autosampler of LC-MS system 402, which may automatically spike sample 410 with IS variants 414. In some examples, the kit may also include hardware (e.g., system 300) and/or software (e.g., executable instructions) that may be executed by system 300 to perform the operations described herein.

LC-MS system 402 may perform an analytical run (e.g., a chromatographic run and a mass analysis) on sample 410 containing target analyte 412 and IS variants 414 added to sample 410. During the analytical run, system 300 may perform various operations associated with targeted quantitation of target analyte 412, as will now be described.

Figure 5:
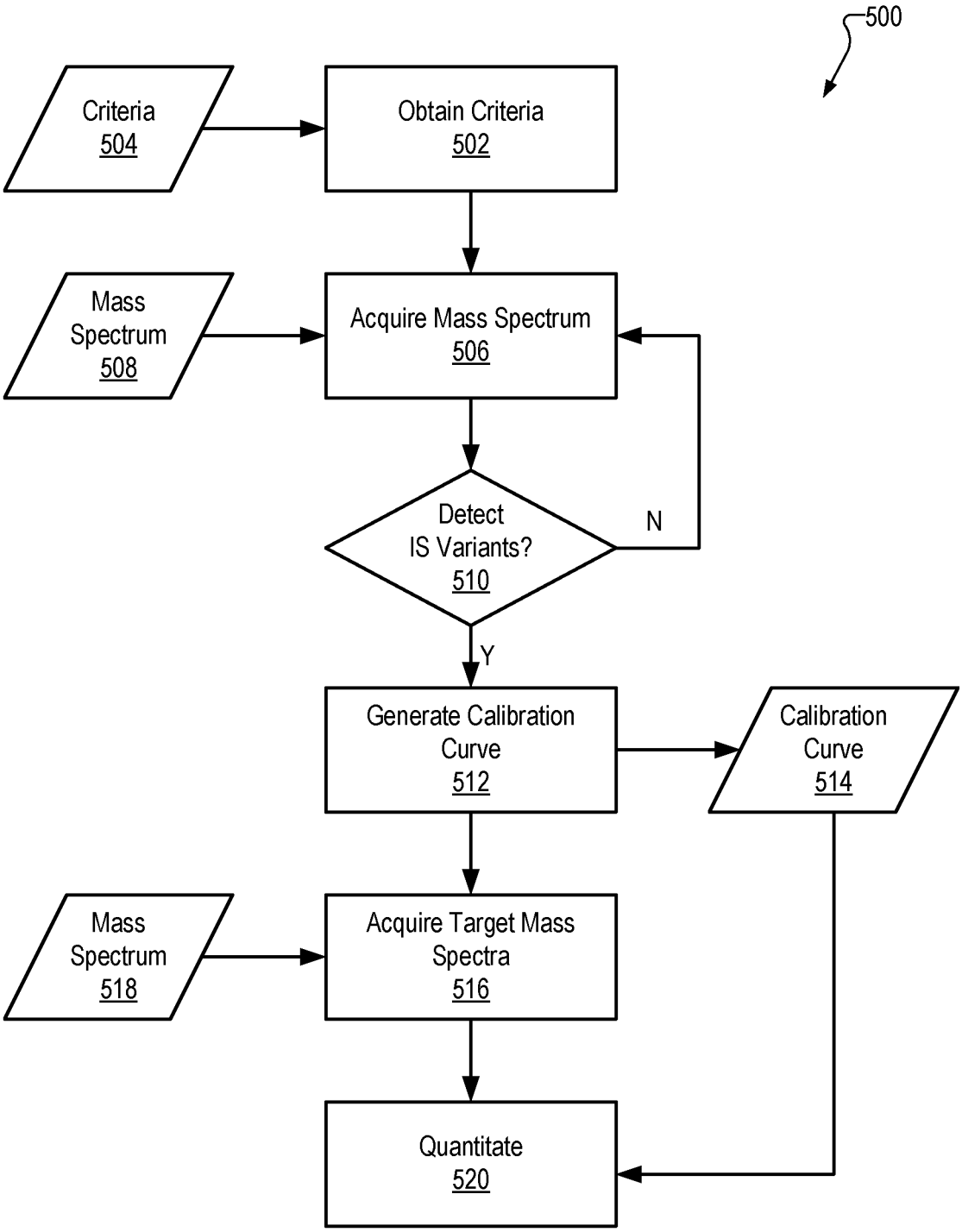
FIG. 5 illustrates an exemplary flowchart of operations performed by the targeted quantitation system of FIG. 3 during a targeted quantitation analysis of a target analyte included in a sample.

FIG. 5 illustrates an exemplary flowchart 500 of operations performed by system 300 during a targeted quantitation analysis of target analyte 412. While FIG. 5 illustrates exemplary operations according to one embodiment, other embodiments may omit, add to, reorder, and/or modify any of the operations shown in FIG. 5.

In step 502, system 300 obtains a set of criteria 504 associated with IS variants 414 and/or target analyte 412. Criteria 504 comprises values of one or more parameters that are detectable by LC-MS system 402 (e.g., by MS 406) and that, when detected, may indicate in real-time the presence of IS variants 414 and/or target analyte 412 in MS 406 (e.g., may indicate the elution of IS variants 414 and/or target analyte 412 from LC 404 and entry into MS 406). As will be explained below in more detail, the real-time detection of IS variants 414 may trigger a quantitation phase in which LC-MS system 402 may configure operating parameters for detection and quantitation of target analyte 412.

The parameters of criteria 504 may include any suitable parameters that are detectable by LC-MS system 402. In some examples, the parameters include a mass-to-charge ratio (m/z) of one or more ions produced from each IS variant 414, expected signal intensity of one or more mass peaks for ions produced from each IS variant 414, and/or the peptide sequence for the IS variants 414. The criteria may specify a particular value or range of values for each parameter. For example, criteria 504 for targeted quantitation of a particular peptide target may include specific values of a mass-to-charge ratio (e.g., 606.824+/−0.03), minimum signal intensity (e.g., >22000), and/or a peptide sequence (e.g., LCDSGELVAIK) for IS variant 414-1, and specific values of the mass-to-charge ratio, signal intensity, and the peptide sequence for IS variants 414-2 and 414-3.

System 300 may obtain criteria 504 in any suitable way. In some examples, system 300 may provide a graphical user interface (GUI) by which a user may enter the values for the parameters. System 300 may receive user input indicating each of the values for the parameters. In additional or alternative examples, system 300 may automatically (e.g., without user input of the parameter values) obtain the values for one or more of the parameters. For instance, certain parameter values may be provided or encoded (e.g., as a barcode, QR code, etc.) on a label attached to a sample container and/or IS variant container. The parameter values may be obtained by a scanner included in LC-MS system 402 (e.g., in an autosampler) or system 300 scanning the label codes. In yet further examples, system 300 may access one or more parameter values from a database (local or remote) based on a target analyte identifier (ID), IS variant ID, etc., which may be input by a user via the GUI or automatically identified, as described above.

While operating in a watch mode of a targeted quantitation analysis, system 300 monitors mass spectra generated during the analytical run to detect, in real-time, the elution of IS variants 414 and target analyte 412 from LC 404. In the watch mode, system 300 acquires, in step 506, a mass spectrum 508 (a "watch mode mass spectrum") generated during an analytical run of sample 410. System 300 may acquire mass spectrum 508 in any suitable way. In some examples, system 300 receives data and/or ion intensity signals from LC-MS system 402 (e.g., from an ion detector) and generates mass spectrum 508 based on the received data and/or signals. Alternatively, LC-MS system 402 generates mass spectrum 508 and transmits data representative of mass spectrum 508 to system 300.

Mass spectrum 508 may be generated from a scan, while operating in the watch mode, by any mass analyzer included in LC-MS system 402. For example, when LC-MS system 402 comprises tandem mass spectrometer 1008, mass spectrum 508 may be generated from a scan by first mass analyzer 104-1 (e.g., an MS1 scan). Alternatively, mass spectrum 508 may be generated from a scan by second mass analyzer 104-3 (e.g., an MS2 scan).

In some examples, system 300 acquires mass spectrum 508 by directing LC-MS system 402 to operate in a first operating mode such that mass spectrum 508 is generated and/or acquired while LC-MS system 402 is operating in the first operating mode. In the first operating mode, one or more operating parameters of LC-MS system 402 may be configured for quick detection of IS variants 414. The operating parameters that may be adjusted may include, for example, resolution, ion inject time, ion fill time, m/z range, and/or any other suitable operating parameter(s).

To illustrate, while operating in the first operating mode LC-MS system 402 may perform a high resolution MS1 full range scan of sample 410. As another illustration, while operating in the first operating mode LC-MS system 402 may perform a fast, low resolution MS2 scan of fragment ions produced from precursor ions of IS variants 414. In some examples, the first operating mode may specify a particular type of scan (e.g., an MS1 scan or an MS2 scan). In additional examples, while operating in the first operating mode LC-MS system 402 may perform an MS2 scan with data-independent acquisition.

In step 510, system 300 analyzes at least mass spectrum 508 to determine whether IS variants 414 are detected. System 300 may detect IS variants 414 in any suitable way. In some examples, system 300 determines whether mass spectrum 508 includes mass peaks corresponding to IS variants 414 (e.g., includes a mass peak for at least one precursor ion for each IS variant 414, or for at least one precursor ion of one IS variant 414). For instance, system 300 may determine whether mass spectrum 508 includes mass peaks that satisfy mass-to-charge ratio (m/z) and possibly intensity values in criteria 504. Additionally or alternatively, system 300 may compare mass spectrum 508 with a library of known mass spectra for IS variants 414. System 300 may use any suitable comparison method as may suit a particular implementation, such as spectral matching or fragmentation matching.

If system 300 does not detect IS variants 414 in mass spectrum 508, system 300 returns processing to step 506 and acquires the next mass spectrum 508. On the other hand, if system 300 detects one or more (or all) IS variants 414 in mass spectrum 508, system 300 proceeds to step 512. In some examples, system 300 proceeds to step 512 in response to detection of all IS variants 414 added to sample 410 (e.g., IS variants 414-1, 414-2, and 414-3). In alternative examples, system 300 may proceed to step 512 in response to detection of at least some of the IS variants added to sample 410 (e.g., detecting both of IS variants 414-1 and 414-2, but not detecting IS variant 414-3) or at least one of the IS variants (e.g., IS variant 414-3).

In step 512, system 300 generates a calibration curve 514 based at least in part on mass spectrum 508. Thus, in some examples the detection of IS variants 414 during the watch mode may trigger the generation of calibration curve 514. Because each IS variant 414 has a different mass and a different but known concentration in sample 410, system 300 can generate calibration curve 514 based at least in part on the mass peaks in mass spectrum 508 for the ions produced from IS variants 414. Calibration curve 514 plots detected intensity vs. concentration. Calibration curve 514 may take any form, such as a table, a regression curve (e.g., a straight line generated based on a linear regression analysis), a set of data, etc. Calibration curve 514 may be generated based on detection of as few as two data points (e.g., based on two different IS variants 414 in sample 410). However, the accuracy and/or reliability of calibration curve 514 may increase with additional data points (e.g., additional IS variants 414). System 300 may store calibration data representative of calibration curve 514 in storage facility 302.

The detection of IS variants 414 during the watch mode may trigger initiation of a quantitation mode. In step 516, system 300 acquires, while operating in the quantitation mode, a mass spectrum 518 (a "quantitation mode mass spectrum") generated during the analytical run of sample 410. The detection of IS variants 414 and/or the generation of calibration curve 514 triggers the acquisition of mass spectrum 518. Because system 300 detected IS variants 414 in step 510, mass spectrum 518 includes mass peaks for product ions produced from target analyte 412. System 300 may acquire mass spectrum 518 in any suitable way, including in any way described herein. Mass spectrum 518 may be acquired at any time after acquisition of mass spectrum 508. In some examples, mass spectrum 518 may represent an aggregation (e.g., an average, etc.) of multiple mass spectra acquired after acquisition of mass spectrum 508.

Although not shown in FIG. 5, system 300 may also include a confirmation step in which system 300 confirms that mass spectrum 518 detects target analyte 412 and/or IS variants 414. This may be done in any suitable way, such as by comparing mass spectrum 518 with a known mass spectrum (e.g., tandem mass spectrum) for target analyte 412 and/or IS variants 414. Exemplary methods for confirming the detection of IS variants 414 are described below in more detail.

Mass spectrum 518 may be generated from a scan by any mass analyzer included in LC-MS system 402. For example, when LC-MS system 402 comprises tandem mass spectrometer 100B, mass spectrum 518 may be generated from a scan by first mass analyzer 104-1 (e.g., an MS1 scan). Alternatively, mass spectrum 508 may be generated from a scan by second mass analyzer 104-3 (e.g., an MS2 or MS/MS scan).

In some examples, system 300 may acquire mass spectrum 518 by also directing LC-MS system 402 to operate in accordance with a second operating mode such that mass spectrum 518 is generated while LC-MS system 402 is operating in the second operating mode. The second operating mode is different from the first operating mode. In the second operating mode, one or more operating parameters of LC-MS system 402 may be configured for identification and quantitation of target analyte 412. For example, in the second operating mode LC-MS system 402 may be configured to perform a scan of target analyte 412 with high quality and high accuracy to produce high quality data. For example, when LC-MS system 402 is implemented by an Orbitrap-based tandem mass spectrometer, LC-MS system 402 may operate at high resolution and high ion fill time.

As shown in FIG. 5, step 516 is performed after step 512. Alternatively, step 512 may be performed after step 516, or step 512 and step 516 may be performed simultaneously. In some examples, step 512 and/or step 516 may be performed in response to the determination that mass spectrum 508 includes mass peaks corresponding to IS variants 414 (step 510). In this way, as explained above, detection of IS variants 414 triggers the generation of calibration curve 514 and triggers the quantitation mode, e.g., a targeted scan of target analyte 412.

In step 520, system 300 may quantitate target analyte 412 based on calibration curve 514 and mass spectrum 518. System 300 may quantitate target analyte 412 in any suitable way. For example, system 300 may determine the concentration of target analyte 412 in sample 410 by extrapolating or interpolating the concentration of target analyte 412 from calibration curve 514 based on the detected signal intensity for target analyte 412 in mass spectrum 518. Based on the identified concentration of target analyte 412 and the known amount of sample 410, system 300 may also determine the absolute quantitation of target analyte 412.

In the examples described above, spectrum 508 and mass spectrum 518 are described in the singular. However, the examples described herein are not limited to a single mass spectrum, as mass spectrum 508 and/or mass spectrum 518 may represent a plurality of mass spectra. Accordingly, calibration curve 514 may be generated based on a plurality of mass spectra 508, and target analyte 412 may be quantitated based on calibration curve 514 and a plurality of mass spectra 518.

Figure 6:
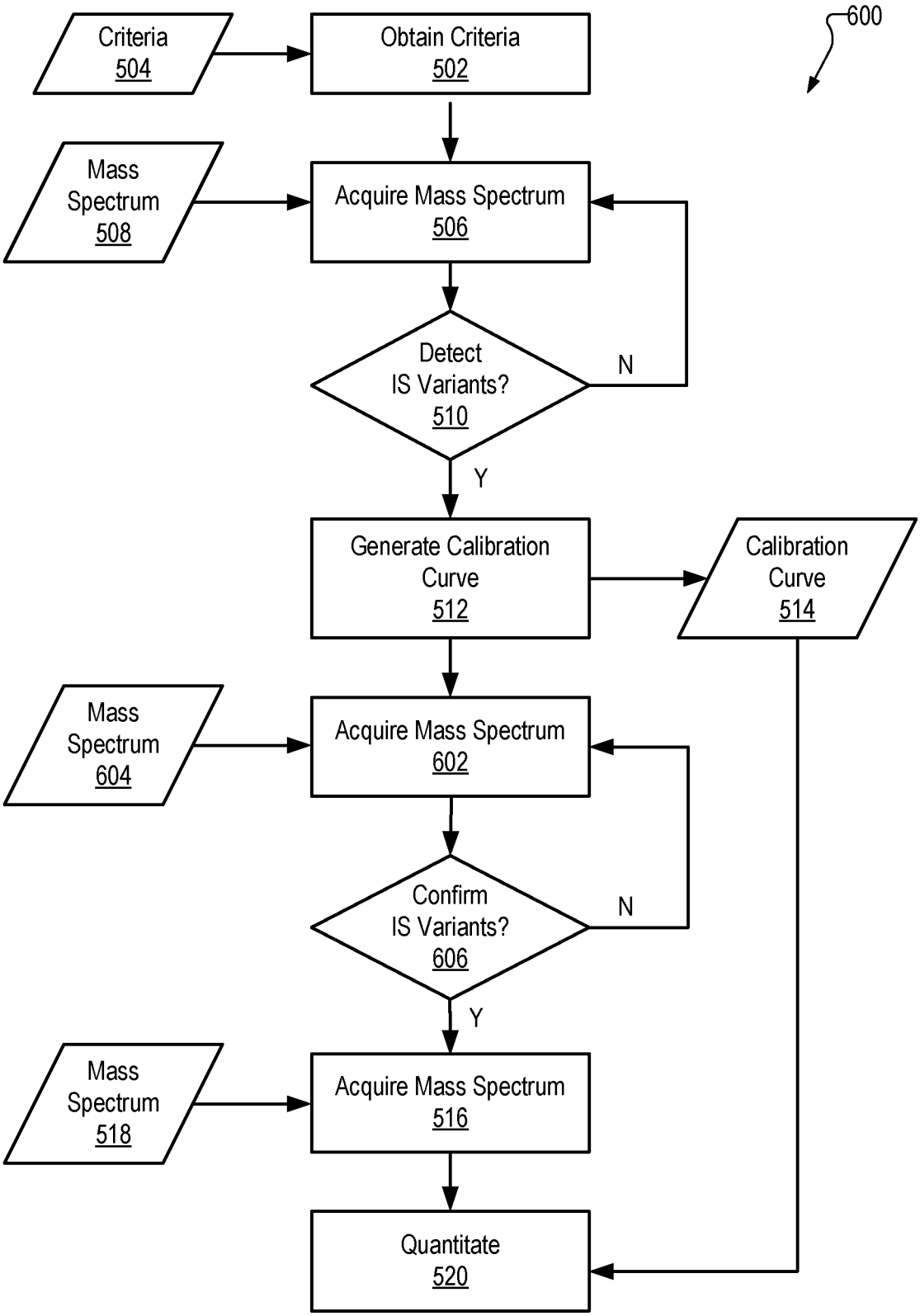
FIGS. 6-8 illustrate various exemplary flowcharts of operations performed by the targeted quantitation system of FIG. 3 during a targeted quantitation analysis of a target analyte.

FIG. 6 illustrates another exemplary flowchart 600 of operations performed by system 300 during a targeted quantitation analysis of target analyte 412. While FIG. 6 illustrates exemplary operations according to one embodiment, other embodiments may omit, add to, reorder, and/or modify any of the operations shown in FIG. 6. Flowchart 600 is similar to flowchart 500 except that the watch mode is divided into a basic watch mode and an enhanced watch mode.

While operating in the basic watch mode, system 300 may detect IS variants 414 (step 510) and, optionally, generate calibration curve 514 (step 512). Detection of IS variants 414 and/or generation of calibration curve 514 may trigger initiation of the enhanced watch mode in which system 300 may confirm detection of IS variants 414. In the enhanced watch mode, system 300 may acquire, in step 602, a mass spectrum 604 (an "enhanced watch mode mass spectrum"). Mass spectrum 604 may be acquired at any time after acquisition of mass spectrum 508 and may be acquired in any suitable way, including any way described herein. In some examples, system 300 may acquire mass spectrum 604 by directing LC-MS system 402 to operate in a third operating mode, which is different from the first and second operating modes, such that mass spectrum 604 is generated while LC-MS system 402 operates in the third operating mode. In the third operating mode, one or more operating parameters of LC-MS system 402 may be configured for confirmation of IS variants 414. In some examples, the third operating mode specifies a particular type of scan (e.g., an MS1 scan or an MS2 scan).

To illustrate, if LC-MS system 402 conducts a high resolution full range scan while operating in the first operating mode, LC-MS system 402 may conduct a low resolution fast scan while operating in the third operating mode. Additionally or alternatively, while operating in the third operating mode LC-MS system 402 may conduct an MS2 scan. For example, LC-MS system 402 may selectively isolate precursor ions detected in step 510 and produced by first mass analyzer 104-1 from IS variants 414, fragment the precursor ions in collision cell 104-2, and scan the fragment ions in second mass analyzer 104-3. Mass spectrum 604 may be generated from the fragment ion scan in second mass analyzer 104-3. Thus, mass spectrum 604 may include mass peaks for fragment ions produced from IS variants 414.

In step 606, system 300 determines, based on mass spectrum 604, whether detection of IS variants 414 is confirmed. System 300 may confirm the detection of IS variants 414 in any suitable way, such as by spectral matching (e.g., dot-product spectral matching), fragmentation matching, or any other suitable method. Fragmentation matching may be performed based on reference peptide sequence(s) specified in criteria 504. For instance, system 300 may acquire, based on criteria 504 (e.g., based on peptide sequence information), reference mass spectra for known fragment ions for the particular peptide sequence. System 300 may confirm the detection of IS variants 414 when system 300 detects, in mass spectrum 604, at least a minimum number of fragment ions for the precursor ion for each IS variant 414. The minimum number of fragment ions (e.g., 5) may be set in advance, either automatically (e.g., based on known reference data) or manually by a user.

If system 300 does not confirm the detection of IS variants 414, system 300 may return to step 602. Alternatively, system 300 may return to step 506 or step 510. If system 300 confirms detection of IS variants 414, system 300 may initiate and operate, in response to the confirmation, in the quantitation mode (e.g., perform steps 516 and 520). That is, confirmation of the detection of IS variants 414 triggers commencement of the quantitation mode.

As with mass spectrum 508 and mass spectrum 518, mass spectrum 604 is not limited to a single mass spectrum but may represent a plurality of mass spectra.

Figure 7:
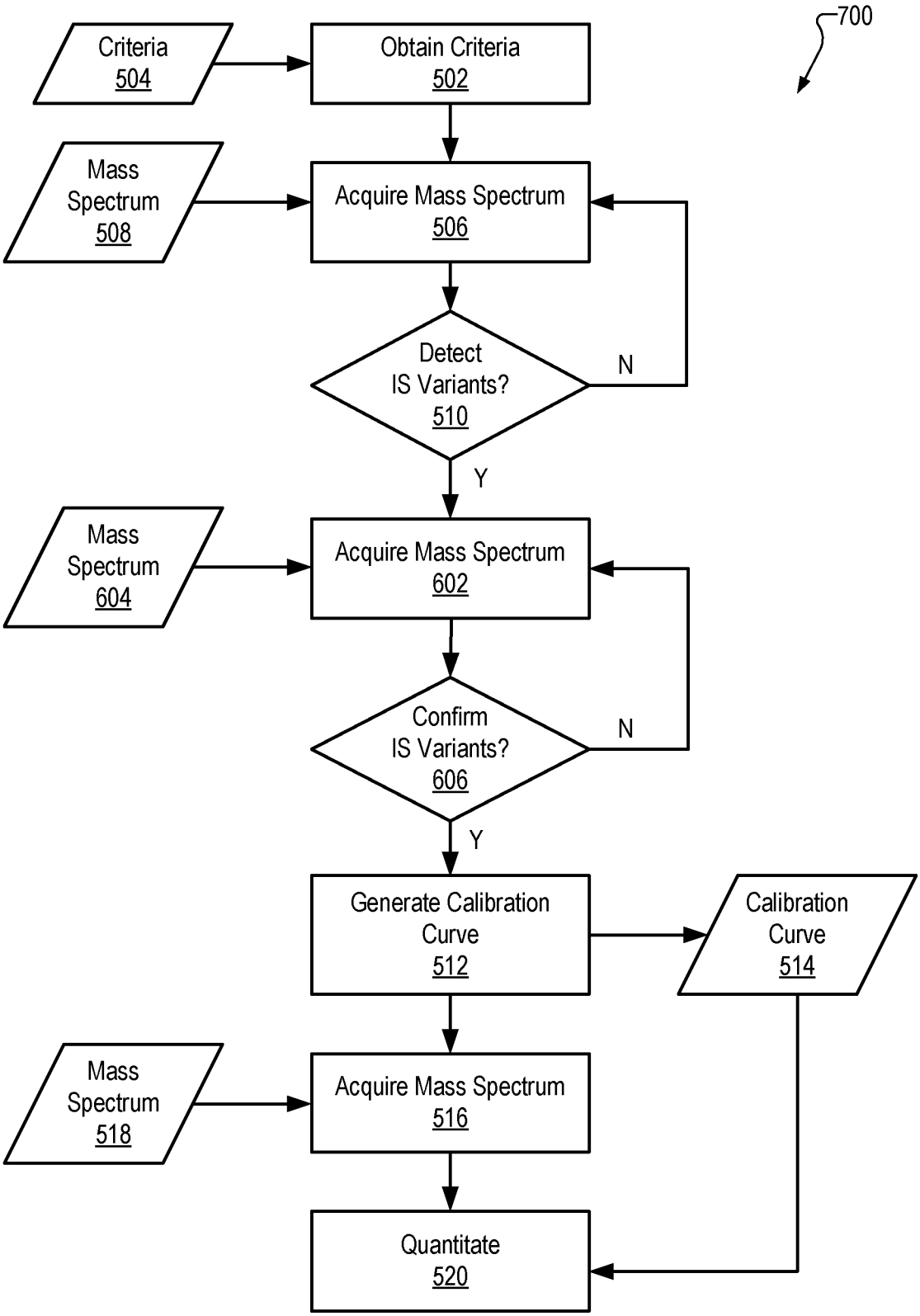

FIG. 7 illustrates another exemplary flowchart 700 of operations performed by system 300 during a targeted quantitation analysis of target analyte 412. While FIG. 7 illustrates exemplary operations according to one embodiment, other embodiments may omit, add to, reorder, and/or modify any of the operations shown in FIG. 7. Flowchart 700 is similar to flowchart 600 except that step 512 (generation of calibration curve 514) is performed in response to step 606 (confirmation of detection of IS variants 414) rather than in response to step 510 (detection of IS variants 414). Calibration curve 514 may be generated based on mass spectrum 508 and/or mass spectrum 604.

Figure 8:
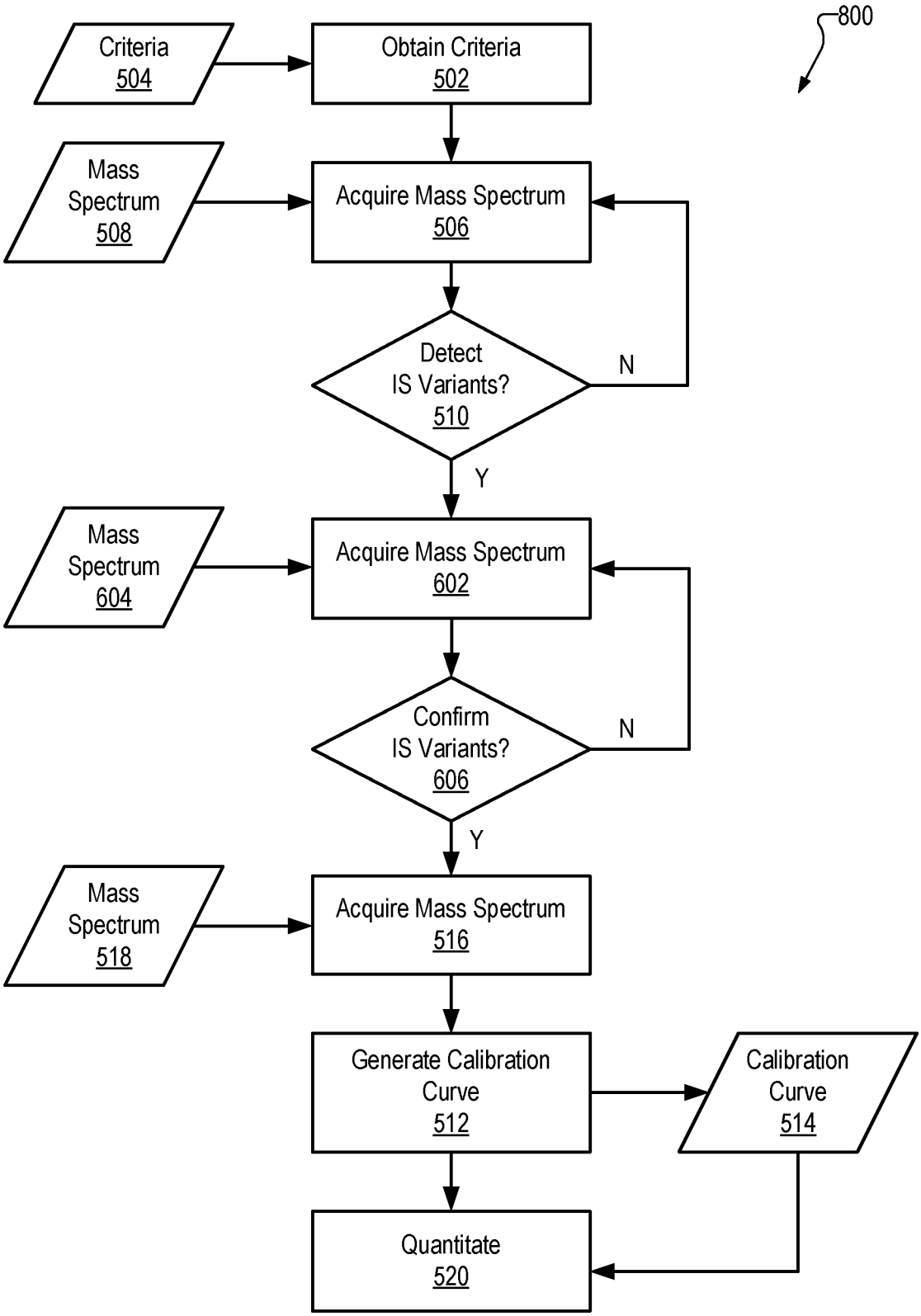

FIG. 8 illustrates another exemplary flowchart 800 of operations performed by system 300 during a targeted quantitation analysis of target analyte 412. While FIG. 8 illustrates exemplary operations according to one embodiment, other embodiments may omit, add to, reorder, and/or modify any of the operations shown in FIG. 8. Flowchart 800 is similar to flowchart 600 except that step 512 (generation of calibration curve 514) is performed in response to step 516 (acquire mass spectrum 518) rather than in response to step 510 (detection of IS variants 414). Calibration curve 514 may thus be generated based on mass spectrum 508, mass spectrum 604, and/or mass spectrum 518.

Figure 9:
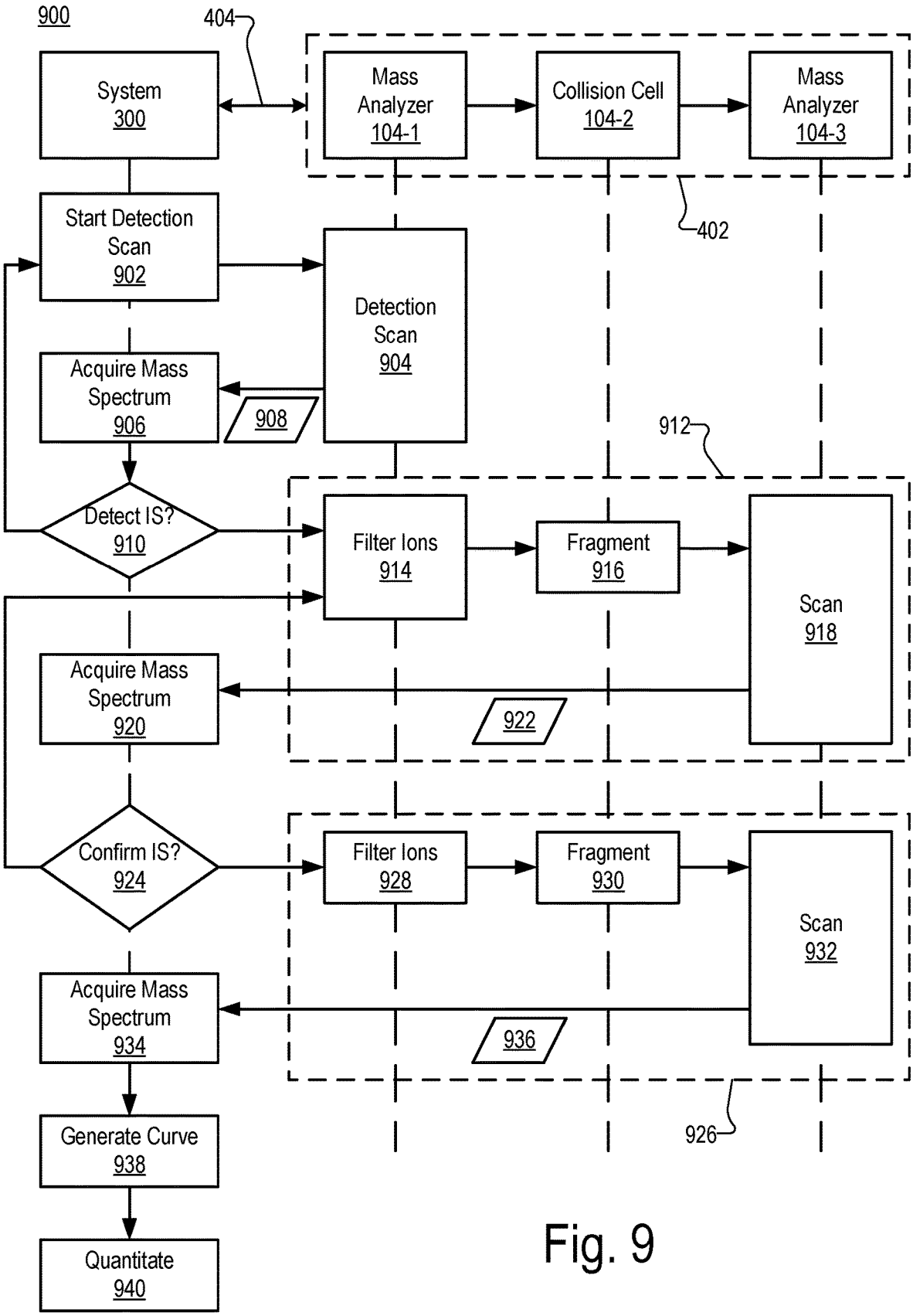
FIG. 9 illustrates an exemplary workflow depicting operations associated with a targeted quantitation analysis of a sample, as performed by the targeted quantitation system of FIG. 3 and a combined liquid chromatography-mass spectrometry system.

Exemplary operations of system 300 and LC-MS system 402 will now be described with reference to FIG. 9. FIG. 9 illustrates an exemplary workflow 900 depicting operations associated with a targeted quantitation analysis of sample 410, as performed by system 300 and LC-MS system 402.

As shown, LC-MS system 402 (e.g. MS 406) comprises first mass analyzer 104-1, collision cell 104-2, and second mass analyzer 104-3. First mass analyzer 104-1 may be implemented by any suitable mass analyzer, such as a quadrupole mass filter. Collision cell 104-2 may be implemented by any suitable collision cell. Second mass analyzer 104-3 may be implemented by any suitable mass analyzer, such as an orbitrap mass analyzer or a time-of-flight mass analyzer. System 300 is communicatively coupled with LC-MS system 402 by link 408.

In step 902, while operating in a basic watch mode, system 300 directs LC-MS system 402 to perform a detection scan of sample 410 with mass analyzer 104-1 (e.g., an MS1 scan). In step 904, LC-MS system 402 runs the detection scan of sample 410 with first mass analyzer 104-1. In alternative embodiments, LC-MS system 402 may run the detection scan with second mass analyzer 104-3 (e.g., an MS2 or MS/MS scan). The detection scan may be configured for real-time detection of IS variants 414 (e.g., for detection of elution of IS variants 414 from LC 404 and entrance into MS 406). To this end, system 300 may direct LC-MS system 402 to operate in a first operating mode when performing the detection scan. In the first operating mode, LC-MS system 402 is configured to enable detection of precursor ions produced from IS variants 414. For example, the detection scan may comprise a high resolution full range scan of the eluent from LC 404.

In step 906, system 300 acquires a mass spectrum 908 generated from the detection scan in step 904 (a "basic watch mode mass spectrum"). In step 910, system 300 analyzes mass spectrum 908 to determine if two or more (or all) IS variants 414 are detected. System 300 may analyze mass spectrum 908 and detect IS variants 414 in any suitable way, including any way described herein. For example, system 300 may analyze mass spectrum 908 to identify mass peaks that have mass-to-charge ratios and signal intensity levels that match a set of criteria. If system 300 does not detect IS variants 414 in mass spectrum 908 (e.g., if mass peaks in mass spectrum 908 do not match the criteria), system 300 may return to step 906 and analyze another mass spectrum. Alternatively, system 300 may return to step 902 and direct LC-MS system 402 to perform another detection scan (step 904).

If system 300 detects IS variants 414 in mass spectrum 908, system 300 may transition to operate in an enhanced watch mode. While operating in the enhanced watch mode, system 300 may direct LC-MS system 402 to perform a confirmation scan 912 to confirm the presence of IS variants 414. In the embodiment of FIG. 9, confirmation scan 912 comprises an MS/MS scan of product ions produced from sample 410. For example, in step 914 LC-MS system 402 selectively filters, in first mass analyzer 104-1, ions produced from sample 410 to produce precursor ions. In step 916, LC-MS system 402 selectively fragments the precursor ions in collision cell 104-2. In step 918, LC-MS system 402 scans the fragment ions in second mass analyzer 104-3. System 300 may direct LC-MS system 402 to operate in a second operating mode when performing confirmation scan 912. In some examples, LC-MS system 402 may perform confirmation scan 912 with low resolution and high speed (e.g., low fill time) while operating in the second operating mode.

In step 920, system 300 acquires a mass spectrum 922 generated from the scan in step 918 (an "enhanced watch mode mass spectrum"). System 300 may acquire mass spectrum 922 in any way described herein. In step 924, system 300 confirms, based on mass spectrum 922, whether IS variants 414 are detected. System 300 may confirm the detection of IS variants 414 in any suitable way, such as by spectral matching, fragmentation matching, and/or any other suitable technique. If system 300 does not confirm the detection of IS variants 414, system 300 may return to step 914 and perform another confirmation scan 912. In alternative embodiments, system 300 may return to step 902 and/or step 906.

If system 300 confirms the detection of IS variants 414 in step 924, system 300 may transition to operate in a quantitation mode. While operating in the quantitation mode, system 300 may direct LC-MS system 402 to perform a targeted quantitation scan 926. In some examples, targeted quantitation scan 926 comprises an MS/MS scan. In targeted quantitation scan 926, LC-MS system 402 is configured to acquire high quality data to be used in quantitating target analyte 412. Accordingly, in step 928 LC-MS system 402 selectively filters, in first mass analyzer 104-1, precursor ions produced from target analyte 412. In step 930, LC-MS system 402 fragments the target analyte precursor ions in collision cell 140-2. In step 932, LC-MS system 402 scans the fragment ions in second mass analyzer 104-3. System 300 may direct LC-MS system 402 to operate in a third operating mode when performing targeted quantitation scan 926. For example, LC-MS system 402 may perform targeted quantitation scan 926 with high resolution and high ion fill time while operating in the third operating mode.

In step 934, system 300 acquires a mass spectrum 936 generated from the scan in step 932 (a "quantitation mode mass spectrum"). System 300 may acquire mass spectrum 936 in any suitable way, including any way described herein. In step 938, system 300 generates a calibration curve. System 300 may generate the calibration curve in any suitable way, including any way described herein. In some examples, the calibration curve is generated based on mass spectrum 936. Alternatively, the calibration curve may be generated based on mass spectrum 908 and/or mass spectrum 922. Moreover, while FIG. 9 shows that the calibration curve is generated after targeted quantitation scan 926, generation of the calibration curve (step 938) may be performed at any other suitable time, such as in response to detection of IS variants 414 (step 910) or in response to confirmation of the detection of IS variants 414 (step 924).

In step 940, system 300 quantitates target analyte 412 based on the calibration curve and mass spectrum 936. System 300 may quantitate target analyte 412 in any suitable way, including in any way described herein. For example, system 300 may determine the concentration of target analyte 412 in sample 410 and/or determine the absolute quantitation of target analyte 412 based on the determined concentration of target analyte 412 and the known quantity of sample 410. In some examples, system 300 may also store (e.g., in storage facility 302) and/or output the calibration curve and/or quantitation data (e.g., data representative of the determined concentration of target analyte 412 and/or absolute quantitation of target analyte 412). Additionally or alternatively, the calibration curve and/or quantitation data may be output to a display device for display, by the display device, of the calibration curve and/or quantitation data.

In the examples described above, mass spectrum 906, mass spectrum 920, and/or mass spectrum 934 are not limited to a single mass spectrum but may each represent a plurality of mass spectra.

In some modifications of the examples described above, system 300 may additionally perform feedback control of LC-MS system 402 based on the detection (or non-detection) of IS variants 414 and/or target analyte 412. For example, system 300 may adjust one or more operating parameters of LC 404 based on the detection (or non-detection) of IS variants 414. To illustrate, system 300 may monitor the elution of IS variants 414 from LC 404. Upon detection of IS variants 414, system 300 may modify the LC gradient to spread out the elution of IS variants 414 to help the mass spectrometer (e.g., mass spectrometer 204) to keep up with high numbers of IS variants eluting from the LC system. In other words, system 300 may space out the LC gradient in response to detection of IS variants 414 (e.g., in response to step 510, step 606, step 910, or step 924). Additionally or alternatively, system 300 may shorten the gradient when IS variants 414 are not detected to favor faster processing. By adjusting or optimizing control of the LC gradient, system 300 may shorten the overall processing time of sample 410 by LC-MS system 402 without sacrificing quality or accuracy of the targeted quantitation analysis. Adjustment or optimization of the LC gradient is only one example, as any other operating parameter of LC 404 may be adjusted based on the detection (or non-detection) of IS variants 414 and/or target analyte 412.

As another example of feedback control, system 300 may adjust one or more operating parameters of MS 406 based on the detection (or non-detection) of target analyte 412. To illustrate, system 300 may determine, during the quantitation phase of a targeted quantitation analysis, that data for target analyte 412 (e.g., mass spectrum 518 or mass spectrum 936) is insufficient, or of insufficient quality, to perform quantitation of target analyte 412. In response to such determination, system 300 may adjust an operating parameter of MS 406 to improve the data quality. For instance, system 300 may, in real-time, increase an ion fill time in the ion source and/or in collision cell 104-2. Increasing the ion fill time may increase the sensitivity of MS 406 and increase the probability of generating high quality data. Additionally or alternatively, system 300 may adjust or optimize a resolution of second mass analyzer 104-3. Adjustment or optimization of ion fill time and/or resolution is only one example, as any other operating parameter of MS 406 may be adjusted based on the detection (or non-detection) of IS variants 414 and/or target analyte 412.

Various modifications may be made to the examples described above. For instance, in the examples above, sample 410 has been described as including only one target analyte 412. However, sample 410 may include any number of target analytes 412 as may suit a particular implementation, as in target multiplexing. In examples involving target multiplexing, a distinct set of IS variants 414 may be added to sample 410 for each target analyte 412. Furthermore, the processes and operations described herein may be independently performed for each different target analyte 412 during a particular analytical run of sample 410.

In some examples, the watch mode (e.g., the enhanced watch mode) and the quantitation mode may run partially concurrently. For example, during the enhanced watch mode of operation, MS2 analyses of target analyte 412 may be interspersed with MS1 analyses and MS2 analyses of IS variants 414. The analyses of IS variants 414 may be used to monitor the progression of the elution in time. However, it will be appreciated that the specificity provided by detecting multiple IS variants 414 during the watch mode may eliminate the need to monitor the progression of the elution in time, thereby improving the efficiency with which a targeted analysis is performed.

Furthermore, in the examples described herein the calibration curve generation and the quantitation of the target analyte are performed substantially in real time (e.g., in response to or near in time after acquiring mass spectrum on which the calibration curve is based) during the targeted quantitation analysis. However, the examples are not limited to real-time, as the calibration curve and target analyte quantitation may be performed at any suitable time as may serve a particular implementation, such as after a targeted quantitation analysis, after a batch of distinct targeted quantitation analyses, etc.

In the examples described above, system 300 may detect IS variants 414 (e.g., step 510 or step 910) by determining whether a mass spectrum (e.g., mass spectrum 508 or mass spectrum 908) includes mass peaks that satisfy mass-to-charge ratio (m/z) and/or signal intensity values in a criteria set (e.g., criteria 504). In some examples, the criteria set also specifies a distinct pattern that must be satisfied as a condition for detection of IS variants 414. Given that each of IS variants 414-1, 414-2, and 414-3 has a distinct mass and a distinct concentration, the combination of mass peaks for IS variants 414-1, 414-2, and 414-3 within a mass spectrum may have a unique pattern. Thus, unique combinations of the masses and concentrations of IS variants 414 may encode a specific signature which, upon detection by system 300, may satisfy the conditions for detection of IS variants 414.

Figure 10A:
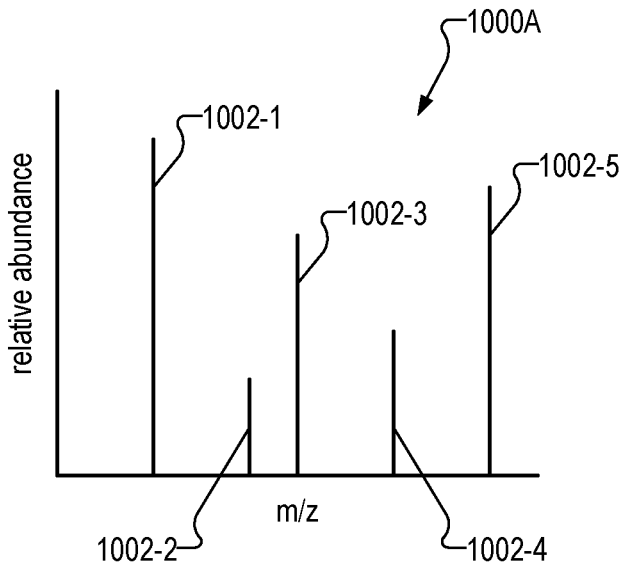
FIG. 10A shows an exemplary mass spectrum that includes a predetermined mass peak pattern comprising a plurality of mass peaks for ions to be produced from a set of five internal standard variants added to a sample.

This is illustrated with reference to FIGS. 10A and 10B. FIG. 10A shows an exemplary mass spectrum 1000A that includes a plurality of mass peaks 1002-1 through 1002-5 for ions to be produced from a set of five IS variants added to a sample. As shown, each mass peak 1002 has a different relative abundance and a different mass-to-charge ratio (m/z). The mass peak pattern (e.g., the arrangement of mass peaks 1002 relative to one another) shown in FIG. 10A may be included in a criteria set as a condition that must be detected for system 300 to determine that a plurality of IS variants added to a sample has been detected. Thus, system 300 may determine that a set of five IS variants are detected during a targeted quantitation analysis when system 300 acquires a mass spectrum that includes mass peaks that match the mass peak pattern of FIG. 10A.

Figure 10B:
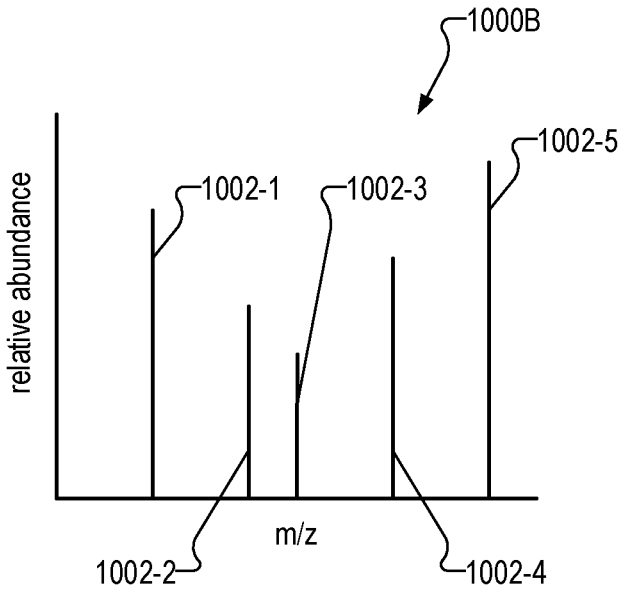
FIG. 10B shows an exemplary mass spectrum acquired during a targeted quantitation analysis.

FIG. 10B shows an exemplary mass spectrum 1000B acquired during a targeted quantitation analysis. In mass spectrum 1000B, mass peaks 1002-1 through 1002-5 have the same m/z values but different relative abundances as compared with mass spectrum 1000A. That is, the IS variants have been added to the sample in concentrations different from the concentrations required to produce the mass peak pattern of mass spectrum 1000A. Accordingly, system 300 does not determine that the set of five IS variants are detected when system 300 acquires mass spectrum 1000B. Thus, as can be seen a predefined mass peak pattern included in a criteria set may improve the accuracy of the detection of the plurality of IS variants and reduce or even eliminate the likelihood of false positive detections of the plurality of IS variants.

In additional or alternative examples, a criteria set (e.g., criteria 504) for detecting IS variants 414 may include a unique, non-linear calibration curve, and system 300 may determine or confirm that IS variants 414 are detected only when the calibration curve generated by system 300 (e.g., calibration curve 514 or the calibration curve generated in step 928) matches the non-linear calibration curve specified in the criteria set. A non-linear calibration curve may be based on IS variants added to the sample in a non-linear range of concentrations. A non-linear calibration curve may have a curve that is unique to the particular IS variants. A calibration curve generated by system 300 during a targeted quantitation analysis of a target analyte and that does not match a predefined calibration curve associated with the IS variants for the target analyte will not trigger commencement of a detection confirmation and/or quantitation phase. Thus, a predefined calibration curve included in a criteria set may improve the accuracy of the detection of the plurality of IS variants and reduce or even eliminate the likelihood of false positive detections of the plurality of IS variants.

In some examples, a targeted quantitation kit may include a set of unique IS variants in a set of containers in unique, predetermined amounts. In some examples, the predetermined amounts of the IS variants in the kit are configured to produce, in a mass analysis, a mass spectrum that matches a predefined mass peak pattern of a criteria set. Additionally or alternatively, the predetermined amounts of the IS variants in the kit are configured to produce a predefined non-linear calibration curve. In some examples, the kit may also include criteria data, including data representative of the predefined mass peak pattern and/or predefined non-linear calibration curve associated with the set of IS variants. In additional examples, the kit may also include hardware (e.g., system 300, storage facility 302, etc.) and/or software (e.g., executable instructions) that may be executed by system 300 to perform the targeted quantitation operations described herein.

In the foregoing embodiments, the concentration and/or absolute quantitation of a target analyte included in a sample may be determined from a single targeted quantitation analysis of the sample. With multiple distinct IS variants spiked in the sample at different concentrations, system 300 can generate the calibration curve from the sample and during the same targeted quantitation analysis, thus eliminating the need to acquire calibration curve data in separate analyses. This allows for more efficient monitoring, detection, and quantitation of a target analyte. Additionally, the detection and/or confirmation of the detection of the multiple IS variants triggers the acquisition of high resolution, high quality data of the target analyte, which data may then be used in conjunction with the calibration curve to quantitate the target analyte. Furthermore, the precise detection and confirmation of the IS variants can eliminate, or substantially reduce, the occurrence of false-positive triggers. Moreover, the specificity of the trigger provided by detection of multiple IS variants can eliminate the need to monitor the detected signal intensities against signal intensity thresholds, thereby reducing necessary processing power and time and improving the efficiency with which system 300 may perform a targeted quantitation analysis.

Figure 11:
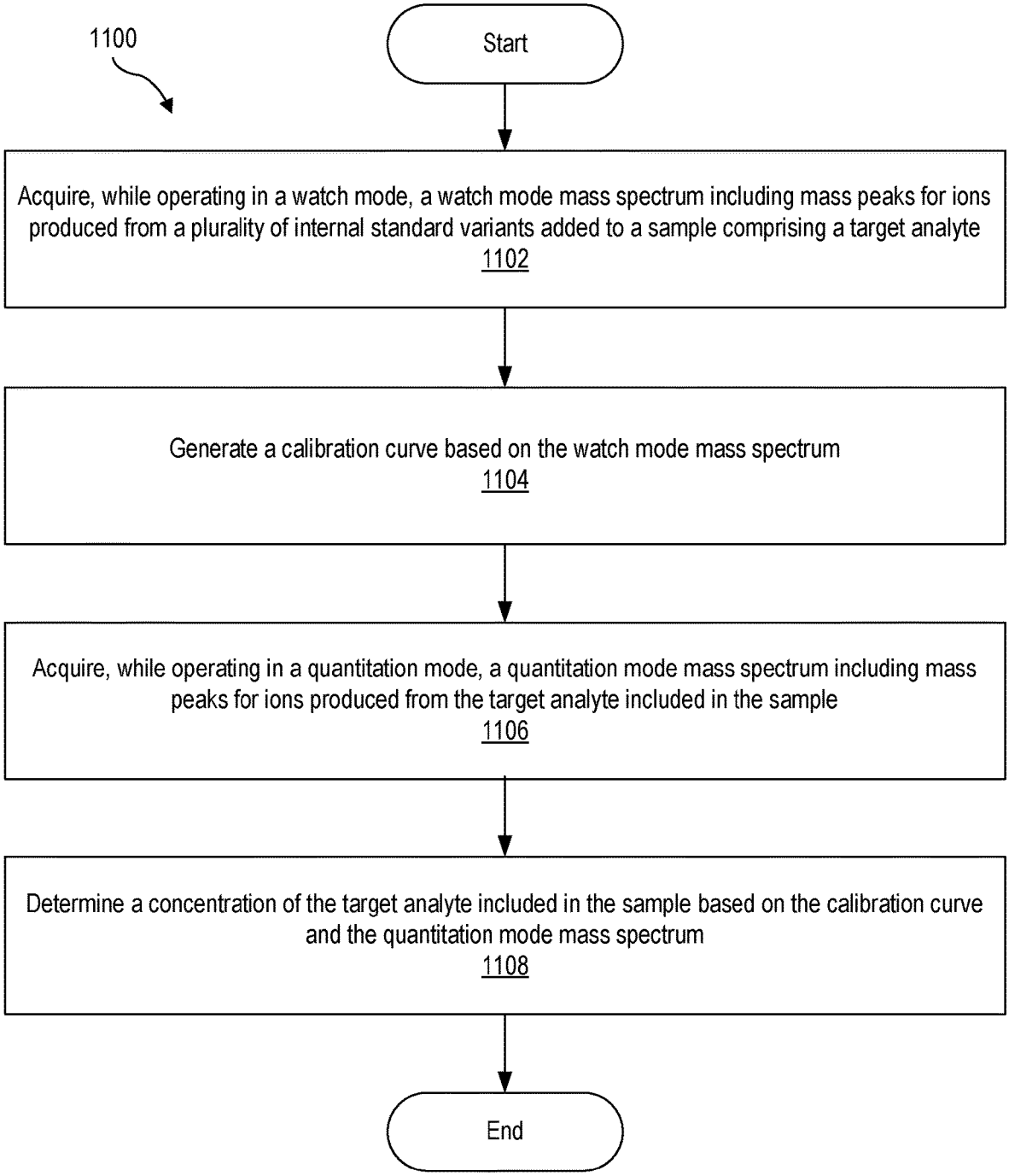
FIG. 11 illustrates an exemplary method of quantitating a target analyte included in a sample.

FIG. 11 illustrates an exemplary method 1100 of quantitating a target analyte included in a sample. While FIG. 11 illustrates exemplary operations according to one embodiment, other embodiments may omit, add to, reorder, and/or modify any of the operations shown in FIG. 11. One or more of the operations shown in FIG. 11 may be performed by system 300, any components included therein, and/or any implementation thereof.

In operation 1102, a watch mode mass spectrum (e.g., mass spectrum 508, mass spectrum 604, mass spectrum 908, or mass spectrum 922) is acquired while operating in a watch mode. The watch mode mass spectrum includes mass peaks for ions produced from a plurality of IS variants (e.g., IS variants 414-1 through 414-3) added to a sample (e.g., sample 411) comprising a target analyte (e.g., target analyte 412). Each IS variant included in the plurality of IS variants comprises a unique isotopologue of the target analyte and is added to the sample in a unique amount. Operation 1102 may be performed in any of the ways described herein.

In operation 1104, a calibration curve (e.g., calibration curve 514 or the calibration curve generated by step 938 of FIG. 9) is generated based on the watch mode mass spectrum. Operation 1104 may be performed in any of the ways described herein.

In operation 1106, a quantitation mode mass spectrum (e.g., mass spectrum 518 or mass spectrum 936) is acquired while operating in a quantitation mode. The quantitation mode mass spectrum includes mass peaks for ions produced from the target analyte included in the sample. Operation 1106 may be performed in any of the ways described herein.

In operation 1108, a concentration of the target analyte included in the sample is determined based on the calibration curve and the quantitation mode mass spectrum. Operation 1108 may be performed in any of the ways described herein.

Figure 12:
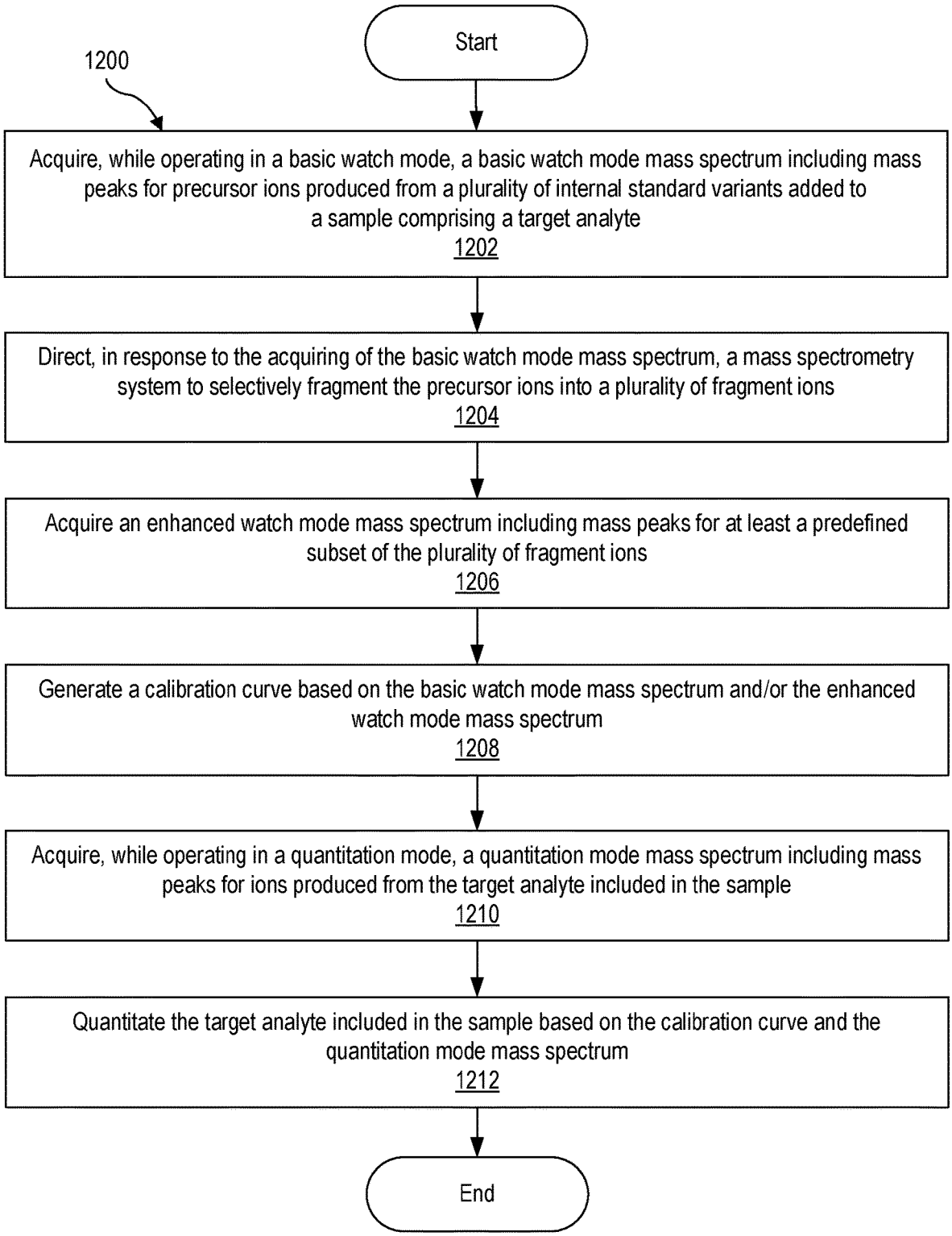
FIG. 12 illustrates another exemplary method of quantitating a target analyte included in a sample.

FIG. 12 illustrates another exemplary method 1200 of quantitating a target analyte included in a sample. While FIG. 12 illustrates exemplary operations according to one embodiment, other embodiments may omit, add to, reorder, and/or modify any of the operations shown in FIG. 12. One or more of the operations shown in FIG. 12 may be performed by system 300, any components included therein, and/or any implementation thereof.

In operation 1202, a basic watch mode mass spectrum (e.g., mass spectrum 508 or mass spectrum 908) is acquired while operating in a basic watch mode of a watch mode. The basic watch mode mass spectrum includes mass peaks for precursor ions produced from a plurality of IS variants (e.g., IS variants 414-1 through 414-3) added to a sample (e.g., sample 410) comprising a target analyte (e.g., target analyte 412). Each IS variant included in the plurality of IS variants comprises a unique isotopologue of the target analyte and is added to the sample in a unique amount. Operation 1202 may be performed in any of the ways described herein.

In operation 1204, a mass spectrometry system (e.g., LC-MS system 402) is directed, in response to the acquiring of the basic watch mode mass spectrum, to selectively fragment the precursor ions into a plurality of fragment ions. Operation 1204 may be performed in any of the ways described herein.

In operation 1206, an enhanced watch mode mass spectrum (e.g., mass spectrum 604 or mass spectrum 922) is acquired while operating in an enhanced watch mode of the watch mode. The enhanced watch mode mass spectrum includes mass peaks for at least a subset of the plurality of fragment ions. Operation 1206 may be performed in any of the ways described herein. In some examples, a distinct enhanced watch mode mass spectrum is acquired from an MS2 scan for each IS variant.

In operation 1208, a calibration curve (e.g., calibration curve 514 or the calibration curve generated by step 938 of FIG. 9) is generated based on the basic watch mode mass spectrum and/or the enhanced watch mode mass spectrum. Operation 1208 may be performed in any of the ways described herein. In some examples, operation 1208 is performed in response to operation 1206.

In operation 1210, a quantitation mode mass spectrum (e.g., mass spectrum 518 or mass spectrum 936) is acquired. The quantitation mode mass spectrum includes mass peaks for ions produced from the target analyte included in the sample. Operation 1210 may be performed in any of the ways described herein. In some examples, operation 12 is performed in response to operation 1206 and/or operation 1208.

In operation 1212, a concentration of the target analyte included in the sample is determined based on the calibration curve and the quantitation mode mass spectrum. Operation 1212 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 13:
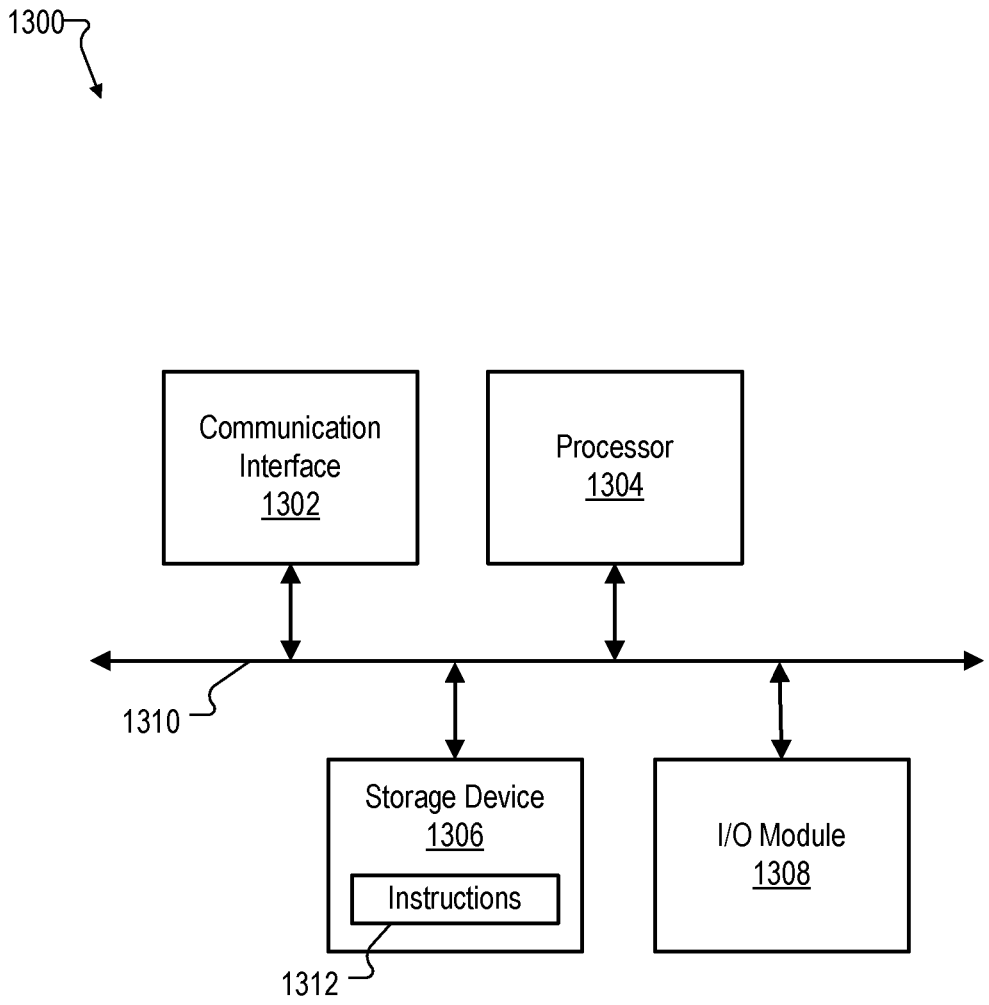
FIG. 13 illustrates an exemplary computing device that may be specifically configured to perform one or more of the processes described herein.

FIG. 13 illustrates an exemplary computing device 1300 that may be specifically configured to perform one or more of the processes described herein. As shown in FIG. 13, computing device 1300 may include a communication interface 1302, a processor 1304, a storage device 1306, and an input/output ("I/O") module 1308 communicatively connected one to another via a communication infrastructure 1310. While an exemplary computing device 1300 is shown in FIG. 13, the components illustrated in FIG. 13 are not intended to be limiting. Additional or alternative components may be used in other embodiments. Components of computing device 1300 shown in FIG. 13 will now be described in additional detail.

Communication interface 1302 may be configured to communicate with one or more computing devices. Examples of communication interface 1302 include, without limitation, a wired network interface (such as a network interface card), a wireless network interface (such as a wireless network interface card), a modem, an audio/video connection, and any other suitable interface.

Processor 1304 generally represents any type or form of processing unit capable of processing data and/or interpreting, executing, and/or directing execution of one or more of the instructions, processes, and/or operations described herein. Processor 1304 may perform operations by executing computer-executable instructions 1312 (e.g., an application, software, code, and/or other executable data instance) stored in storage device 1306.

Storage device 1306 may include one or more data storage media, devices, or configurations and may employ any type, form, and combination of data storage media and/or device. For example, storage device 1306 may include, but is not limited to, any combination of the non-volatile media and/or volatile media described herein. Electronic data, including data described herein, may be temporarily and/or permanently stored in storage device 1306. For example, data representative of computer-executable instructions 1312 configured to direct processor 1304 to perform any of the operations described herein may be stored within storage device 1306. In some examples, data may be arranged in one or more databases residing within storage device 1306.

I/O module 1308 may include one or more I/O modules configured to receive user input and provide user output. One or more I/O modules may be used to receive input for a single virtual experience. I/O module 1308 may include any hardware, firmware, software, or combination thereof supportive of input and output capabilities. For example, I/O module 1308 may include hardware and/or software for capturing user input, including, but not limited to, a keyboard or keypad, a touchscreen component (e.g., touchscreen display), a receiver (e.g., an RF or IR receiver), motion sensors, and/or one or more input buttons.

I/O module 1308 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1308 is configured to provide graphical data to a display for presentation to a user. The graphical data may be representative of one or more graphical user interfaces and/or any other graphical content as may serve a particular implementation.

In some examples, any of the systems (e.g., system 300), computing devices, and/or other components described herein may be implemented by computing device 1300. For example, processing facility 304 may be implemented by processor 1304 and storage facility 302 may be implemented by storage device 1306.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system for mass spectrometry comprising:

a memory storing instructions; and a processor communicatively coupled to the memory and configured to execute the instructions to:

acquire, while operating in a watch mode, a watch mode mass spectrum including mass peaks for ions produced from a plurality of internal standards added to a sample comprising a target analyte, each internal standard included in the plurality of internal standards comprising a unique isotopologue of the target analyte and being added to the sample in a unique amount;

generate a calibration curve based on the watch mode mass spectrum;

acquire, while operating in a quantitation mode, a quantitation mode mass spectrum including mass peaks for ions produced from the target analyte included in the sample; and determine a concentration of the target analyte included in the sample based on the calibration curve and the quantitation mode mass spectrum.

2. The system of claim 1, wherein the processor is further configured to execute the instructions to:

acquire, while operating in the watch mode, mass spectra during an analytical run of the sample, the mass spectra including the watch mode mass spectrum;

analyze the mass spectra based on a criteria set associated with the plurality of internal standards; and determine, based on the analysis, that the watch mode mass spectrum includes the mass peaks for the ions produced from the plurality of internal standards added to the sample.

3. The system of claim 2, wherein the acquiring of the quantitation mode mass spectrum is performed in response to the determination that the watch mode mass spectrum includes the mass peaks for the ions produced from the plurality of internal standards added to the sample.

4. The system of claim 2, wherein the generating of the calibration curve is performed in response to the determination that the watch mode mass spectrum includes the mass peaks for the ions produced from the plurality of internal standards added to the sample.

5. The system of claim 2, wherein the determining that the watch mode mass spectrum includes the mass peaks for the ions produced from the plurality of internal standards added to the sample comprises determining that a set of mass peaks included in the watch mode mass spectrum satisfy the criteria set, the set of mass peaks comprising the mass peaks for the ions produced from the plurality of internal standards.

6. The system of claim 5, wherein the criteria set comprises one or more of: a mass-to-charge ratio, a signal intensity, or a peptide sequence for each of the plurality of internal standards added to the sample.

7. The system of claim 1, wherein:

the watch mode comprises a basic watch mode and an enhanced watch mode, the watch mode mass spectrum comprises an enhanced watch mode mass spectrum, and the processor is further configured to execute the instructions to:

acquire, while operating in the basic watch mode, a basic watch mode mass spectrum including mass peaks for precursor ions produced from the plurality of internal standards;

direct, in response to the acquiring of the basic watch mode mass spectrum, a mass spectrometry system to selectively fragment the precursor ions into a plurality of fragment ions, the plurality of fragment ions comprising the ions produced from the plurality of internal standards; and acquire, while operating in the enhanced watch mode, the enhanced watch mode mass spectrum from a scan of the plurality of fragment ions.

8. The system of claim 1, wherein the processor is further configured to execute the instructions to:

direct a mass spectrometry system to scan the ions produced from the plurality of internal standards added to the sample in accordance with a first operating mode such that the watch mode mass spectrum is generated while the mass spectrometry system operates in the first operating mode; and direct the mass spectrometry system to scan the ions produced from the target analyte included in the sample in accordance with a second operating mode such that the quantitation mode mass spectrum is generated while the mass spectrometry system operates in the second operating mode.

9. A method for mass spectrometry comprising:

acquiring, by a targeted quantitation system while operating in a watch mode, a watch mode mass spectrum including mass peaks for ions produced from a plurality of internal standards added to a sample comprising a target analyte, each internal standard included in the plurality of internal standards comprising a unique isotopologue of the target analyte and being added to the sample in a unique amount;

generating, by the targeted quantitation system, a calibration curve based on the watch mode mass spectrum;

acquiring, by the targeted quantitation system while operating in a quantitation mode, a quantitation mode mass spectrum including mass peaks for ions produced from the target analyte included in the sample; and determining, by the targeted quantitation system, a concentration of the target analyte included in the sample based on the calibration curve and the quantitation mode mass spectrum.

10. The method of claim 9, further comprising:

acquiring, by the targeted quantitation system while operating in the watch mode, mass spectra during an analytical run of the sample, the mass spectra including the watch mode mass spectrum;

analyzing, by the targeted quantitation system, the mass spectra based on a criteria set associated with the plurality of internal standards; and determining, by the targeted quantitation system based on the analysis, that the watch mode mass spectrum includes the mass peaks for the ions produced from the plurality of internal standards added to the sample.

11. The method of claim 10, wherein the acquiring of the quantitation mode mass spectrum is performed in response to the determination that the watch mode mass spectrum includes the mass peaks for the ions produced from the plurality of internal standards added to the sample.

12. The method of claim 10, wherein the generating of the calibration curve is performed in response to the determination that the watch mode mass spectrum includes the mass peaks for the ions produced from the plurality of internal standards added to the sample.

13. The method of claim 10, wherein the determining that the watch mode mass spectrum includes the mass peaks for the ions produced from the plurality of internal standards added to the sample comprises determining that a set of mass peaks included in the watch mode mass spectrum satisfy the criteria set, the set of mass peaks comprising the mass peaks for the ions produced from the plurality of internal standards.

14. The method of claim 13, wherein the criteria set comprises one or more of: a mass-to-charge ratio, a signal intensity, or a peptide sequence for each of the plurality of internal standards added to the sample.

15. The method of claim 9, wherein:

the watch mode comprises a basic watch mode and an enhanced watch mode, the watch mode mass spectrum comprises an enhanced watch mode mass spectrum, and the method further comprises:

acquiring, by the targeted quantitation system while operating in the basic watch mode, a basic watch mode mass spectrum including mass peaks for precursor ions produced from the plurality of internal standards;

determining, by the targeted quantitation system, that the mass peaks for the precursor ions satisfy a criteria set associated with the plurality of internal standards;

directing, by the targeted quantitation system in response to the determination that the mass peaks for the precursor ions satisfy the predefined criteria set, a mass spectrometry system to selectively fragment the precursor ions into a plurality of fragment ions, the plurality of fragment ions comprising the ions produced from the plurality of internal standards; and acquiring, while operating in the enhanced watch mode, the enhanced watch mode mass spectrum from a scan of the plurality of fragment ions.

16. The method of claim 9, further comprising:

directing, by the targeted quantitation system, a mass spectrometry system to scan the ions produced from the plurality of internal standards added to the sample in accordance with a first operating mode during the acquiring of the watch mode mass spectrum; and directing, by the targeted quantitation system, the mass spectrometry system to scan the ions produced from the target analyte included in the sample in accordance with a second operating mode during the acquiring of the quantitation mode mass spectrum.

17. A non-transitory computer-readable medium storing instructions that, when executed, direct at least one processor of a computing device for mass spectrometry to:

acquire, while operating in a watch mode, a watch mode mass spectrum including mass peaks for ions produced from a plurality of internal standards added to a sample comprising a target analyte, each internal standard included in the plurality of internal standards comprising a unique isotopologue of the target analyte and being added to the sample in a unique amount;

generate a calibration curve based on the watch mode mass spectrum;

acquire, while operating in a quantitation mode, a quantitation mode mass spectrum including mass peaks for ions produced from the target analyte included in the sample; and determine a concentration of the target analyte included in the sample based on the calibration curve and the quantitation mode mass spectrum.

18. The computer-readable medium of claim 17, wherein the instructions, when executed, further direct the at least one processor to:

acquire, while operating in the watch mode, mass spectra during an analytical run of the sample, the mass spectra including the watch mode mass spectrum;

analyze the mass spectra based on a criteria set associated with the plurality of internal standards; and determine, based on the analysis, that the watch mode mass spectrum includes the mass peaks for the ions produced from the plurality of internal standards added to the sample.

19. The computer-readable medium of claim 18, wherein the acquiring of the quantitation mode mass spectrum is performed in response to the determination that the watch mode mass spectrum includes the mass peaks for the ions produced from the plurality of internal standards added to the sample.

20. The computer-readable medium of claim 18, wherein the generating of the calibration curve is performed in response to the determination that the watch mode mass spectrum includes the mass peaks for the ions produced from the plurality of internal standards added to the sample.

21. The computer-readable medium of claim 18, wherein the determining that the watch mode mass spectrum includes the mass peaks for the ions produced from the plurality of internal standards added to the sample comprises determining that a set of mass peaks included in the watch mode mass spectrum satisfy the criteria set, the set of mass peaks comprising the mass peaks for the ions produced from the plurality of internal standards.

22. The computer-readable medium of claim 21, wherein the criteria set comprises one or more of: a mass-to-charge ratio, a signal intensity, or a peptide sequence for each of the plurality of internal standards added to the sample.

23. The computer-readable medium of claim 17, wherein:

the watch mode comprises a basic watch mode and an enhanced watch mode, the watch mode mass spectrum comprises an enhanced watch mode mass spectrum, and the instructions, when executed, further direct the at least one processor to:

acquire, while operating in the basic watch mode, a basic watch mode mass spectrum including mass peaks for precursor ions produced from the plurality of internal standards;

determine that the mass peaks for the precursor ions satisfy a criteria set associated with the plurality of internal standards;

direct, in response to the determination that the mass peaks for the precursor ions satisfy the predefined criteria set, a mass spectrometry system to selectively fragment the precursor ions into a plurality of fragment ions, the plurality of fragment ions comprising the ions produced from the plurality of internal standards; and acquire, while operating in the enhanced watch mode, the enhanced watch mode mass spectrum from a scan of the plurality of fragment ions.

24. The computer-readable medium of claim 17, wherein the instructions, when executed, further direct the at least one processor to:

direct a mass spectrometry system to scan the ions produced from the plurality of internal standards added to the sample in accordance with a first operating mode during the acquiring of the watch mode mass spectrum; and direct the mass spectrometry system to scan the ions produced from the target analyte included in the sample in accordance with a second operating mode during the acquiring of the second mass spectrum.

* * * * *